US010807780B2

(12) United States Patent
Harada et al.

(10) Patent No.: US 10,807,780 B2
(45) Date of Patent: Oct. 20, 2020

(54) LIQUID STORAGE CONTAINER AND METHOD FOR FOLDING THE CONTAINER

(71) Applicant: DAI NIPPON PRINTING CO., LTD., Tokyo-to (JP)

(72) Inventors: Ryo Harada, Tokyo-to (JP); Hiroaki Gotou, Tokyo-to (JP); Masato Miyake, Tokyo-to (JP); Shota Nishimura, Tokyo-to (JP); Noriko Kumazawa, Tokyo-to (JP); Katsuyuki Motai, Tokyo-to (JP)

(73) Assignee: DAI NIPPON PRINTING CO., LTD., Tokyo (JP)

( * ) Notice: Subject to any disclaimer, the term of this patent is extended or adjusted under 35 U.S.C. 154(b) by 0 days.

(21) Appl. No.: 15/859,980

(22) Filed: Jan. 2, 2018

(65) Prior Publication Data

US 2018/0162620 A1 Jun. 14, 2018

Related U.S. Application Data

(63) Continuation of application No. 14/912,471, filed as application No. PCT/JP2014/071063 on Aug. 8, 2014, now Pat. No. 9,926,124.

(30) Foreign Application Priority Data

Aug. 20, 2013 (JP) ..... 2013-170671

(51) Int. Cl.
*B65D 75/58* (2006.01)
*A61J 1/10* (2006.01)
(Continued)

(52) U.S. Cl.
CPC ..... *B65D 75/5883* (2013.01); *A45D 34/00* (2013.01); *A61J 1/10* (2013.01);
(Continued)

(58) Field of Classification Search
CPC .... B65D 75/5883; B65D 77/06; B31B 50/78; B31B 2120/70; A61J 1/10; A61J 9/001;
(Continued)

(56) References Cited

U.S. PATENT DOCUMENTS

| | | | | |
|---|---|---|---|---|
| 9,868,584 | B2 * | 1/2018 | Harada | B65D 83/0055 |
| 2006/0180589 | A1 | 8/2006 | De Muinck | |
| 2009/0230132 | A1 | 9/2009 | Takedutsumi et al. | |

FOREIGN PATENT DOCUMENTS

| | | | |
|---|---|---|---|
| JP | S59-084770 | A | 5/1984 |
| JP | H07-207237 | A | 8/1995 |

(Continued)

OTHER PUBLICATIONS

May 8, 2018 Office Action issued in Japanese Patent Application No. 2015-133429.

(Continued)

*Primary Examiner* — Donnell A Long
(74) *Attorney, Agent, or Firm* — Oliff PLC

(57) ABSTRACT

A liquid storage container which can be securely inflated within an external container. The liquid storage container includes a bag body and an ejection outlet. The bag body includes a plurality of bellows portions formed by accordion-folding the bag body along longitudinal crease lines, and has a double-folded portion formed by folding the bag body along an upper lateral crease line and a lower lateral crease line. With reference to the bag body, the following relations are satisfied: 10%<X/H<50%, 3%<Y/H<10%, where H is the length of the bag body, x is the distance between the top periphery and the lower lateral crease line, and Y is the distance between the upper lateral crease line and the lower lateral crease line.

10 Claims, 18 Drawing Sheets

(51) Int. Cl.

| | |
|---|---|
| ***A45D 34/00*** | (2006.01) |
| ***B65H 45/20*** | (2006.01) |
| ***B65D 77/06*** | (2006.01) |
| ***A61J 9/00*** | (2006.01) |
| ***B31B 50/78*** | (2017.01) |
| *B31B 120/70* | (2017.01) |

(52) U.S. Cl.
CPC ..... *A61J 9/001* (2013.01); *B31B 50/78* (2017.08); *B65D 77/06* (2013.01); *B65H 45/20* (2013.01); *A45D 2034/005* (2013.01); *B31B 2120/70* (2017.08)

(58) Field of Classification Search
CPC ... B65H 45/20; A45D 34/00; A45D 2034/005
See application file for complete search history.

(56) References Cited

FOREIGN PATENT DOCUMENTS

| | | | | |
|---|---|---|---|---|
| JP | H09-240731 | A | | 9/1997 |
| JP | 2003-002362 | A | | 1/2003 |
| JP | 2007-153349 | A | | 6/2007 |
| JP | 2008-007153 | A | | 1/2008 |
| JP | 2008-007154 | A | | 1/2008 |
| JP | 2009-51513 | A | | 3/2009 |
| JP | 2010-235151 | A | | 10/2010 |
| JP | 2010-235197 | A | | 10/2010 |
| JP | 2010235197 | A | * | 10/2010 |
| JP | 2013-060220 | A | | 4/2013 |
| JP | 2013060220 | A | * | 4/2013 |
| JP | 5238581 | B2 | | 7/2013 |

OTHER PUBLICATIONS

Nov. 4, 2014 Search Report issued in International Patent Application No. PCT/JP2014/071063.
Feb. 23, 2016 International Preliminary Report on Patentability issued in International Patent Application No. PCT/JP2014/071063.
Nov. 15, 2016 Office Action issued in Chinese Patent Application No. 201480032688.
Jul. 25, 2017 Office Action issued in Korean Patent Application No. 10-2016-7000276.
May 8, 2017 Office Action issued in U.S. Appl. No. 14/912,471.
U.S. Appl. No. 14/912,471, filed Feb. 17, 2016 in the name of Harada et al.
Jan. 3, 2018 Office Action issued in Chinese Patent Application No. 201610622153.9.
Jan. 26, 2018 Office Action issued in Japanese Application No. 2015-133429.
Aug. 28, 2018 Office Action issued in Korean Patent Application No. 10-2016-7000276.
Jul. 31, 2018 Office Action issued in Chinese Patent Application No. 201610622153.9
Aug. 8, 2019 Office Action issued in Korean Patent Application No. 10-2015-7026802.
Jul. 26, 2019 Office Action issued in Japanese Patent Application No. 2018-177957.

* cited by examiner

LIQUID STORAGE CONTAINER AND METHOD FOR FOLDING THE CONTAINER

This is a Continuation of application Ser. No. 14/912,471 filed Feb. 17, 2016, which is a National Stage of International Application No. PCT/JP2014/071063 filed Aug. 8, 2014, which claims the benefit of Japanese Application No. 2013-170671 filed Aug. 20, 2013. The disclosures of the prior applications are hereby incorporated by reference herein in their entireties.

TECHNICAL FIELD

The present invention relates to a liquid storage container to be housed and used in an external container and a method for folding the container, and more particularly to a liquid storage container to be housed in an external container and to be used for storage and transport of fluid contents in the fields of industrial chemicals, pharmaceuticals, cosmetic materials, etc., and a method for folding the container.

BACKGROUND ART

A liquid storage container for housing fluid contents has been used in an external container made of, for example, aluminum, steel, stainless steel or fiber board, to store and transport the fluid contents in the fields of industrial chemicals, pharmaceuticals, cosmetic materials, etc.

Such a complex container can be reused simply by taking a used liquid storage container out of an external container, and setting a new liquid storage container in the external container. Thus, compared to the case of filling fluid contents directly into an external container, e.g. made of steel, without using a liquid storage container, the use of such a complex container has the advantages of saving the trouble of cleaning, etc. Complex containers are therefore widely used for industrial chemicals, pharmaceuticals, cosmetic materials, etc.

A liquid storage container is known which includes a bag body composed of an inner body and an outer body, and an ejection outlet mounted to the bag body. The liquid storage container is first folded into a compact configuration and inserted into an external container through the opening of the external container. Thereafter, nitrogen gas is supplied into the liquid storage container to inflate it within the external container. Liquid contents are then filled into the inflated liquid storage container.

PRIOR ART DOCUMENT

Patent Document

Patent document 1: Japanese Patent Laid-Open Publication No. 2008-7154

DISCLOSURE OF THE INVENTION

Problems to be Solved by the Invention

As described above, it is conventional practice to fold a liquid storage container into a compact configuration, insert the folded container through an opening into an external container, and inflate the liquid storage container within the external container by supplying nitrogen gas into the liquid storage container.

However, it is difficult to sufficiently inflate the liquid storage container within the external container. Insufficient inflation of the liquid storage container leads to a decrease in the interior volume of the container.

The present invention has been made in view of the above situation. It is therefore an object of the present invention to provide a liquid storage container which can be sufficiently inflated within an external container before filling liquid contents into the liquid storage container, and a method for folding the liquid storage container.

Means for Solving the Problems

The present invention, in one aspect, provides a liquid storage container to be housed in an external container having an opening, comprising: a bag body composed of an inner bag and an outer bag which are heat-sealed together; and an ejection outlet provided at a top periphery of the bag body and to be attached/detached to/from the opening of the external container, wherein the bag body has the top periphery, a bottom periphery and two side peripheries, wherein the bag body includes a plurality of bellows portions formed by accordion-folding the bag body along longitudinally-extending longitudinal crease lines, and has a double-folded portion formed by folding the bag body along an upper lateral crease line and a lower lateral crease line, and wherein the following relations are satisfied:

$$10\%<X/H<50\%, 3\%<Y/H<10\%$$

where H is the length of the bag body, X is the distance between the top periphery and the lower lateral crease line, and Y is the distance between the upper lateral crease line and the lower lateral crease line.

In a preferred embodiment of the liquid storage container according to the present invention, the top periphery of the bag body includes two heat-sealed portions, the bottom periphery includes a single heat-sealed portion, and the two side peripheries each include a single heat-sealed portion.

In a preferred embodiment of the liquid storage container according to the present invention, the bag body has a pair of folded portions each formed by folding a top periphery-side corner portion of a single side periphery-side bellows portion of the bag body; and the length a of each folded portion and the length H of the bag body satisfy the following relation: $3\%<a/H<20\%$.

In a preferred embodiment of the liquid storage container according to the present invention, the bag body has a pair of folded portions each formed by folding a top periphery-side corner portion of a plurality of side periphery-side bellows portions of the bag body; and the length a of each folded portion and the length H of the bag body satisfy the following relation: $3\%<a/H<20\%$.

In a preferred embodiment of the liquid storage container according to the present invention, the width b of each folded portion and the width W of each bellows portion satisfy the following relation: $\frac{1}{2}\times W\leq b\leq W$.

In a preferred embodiment of the liquid storage container according to the present invention, the bag body, in its lower portion, has a bottom folded portion.

In a preferred embodiment of the liquid storage container according to the present invention, the outer bag of the bag body has an elongation of 300% to 500%.

The present invention, in another aspect, provides a method for folding a liquid storage container to be housed in an external container having an opening, comprising the steps of: preparing a liquid storage container comprising a bag body composed of an inner bag and an outer bag which are heat-sealed together, and an ejection outlet provided at a top periphery of the bag body and to be attached/detached to/from the opening of the external container, said bag body having the top periphery, a bottom periphery and two side peripheries; accordion-folding the bag body along longitudinally-extending longitudinal crease lines to form a plurality of bellows portions; and folding the bag body along an upper lateral crease line and a lower lateral crease line to form a double-folded portion, wherein the following relations are satisfied:

$$10\%<X/H<50\%, 3\%<Y/H<10\%$$

where H is the length of the bag body, X is the distance between the top periphery and the lower lateral crease line, and Y is the distance between the upper lateral crease line and the lower lateral crease line.

In a preferred embodiment of the method for folding a liquid storage container according to the present invention, a pair of folded portions is formed each by folding a top periphery-side corner portion of a single side periphery-side bellows portion of the bag body; and the length a of each folded portion and the length H of the bag body satisfy the following relation: $3\%<a/H<20\%$.

In a preferred embodiment of the method for folding a liquid storage container according to the present invention, a pair of folded portions is formed each by folding a top periphery-side corner portion of a plurality of side periphery-side bellows portions of the bag body; and the length a of each folded portion and the length H of the bag body satisfy the following relation: $3\%<a/H<20\%$.

In a preferred embodiment of the method for folding a liquid storage container according to the present invention, the width b of each folded portion and the width W of each bellows portion satisfy the following relation: $\frac{1}{2}\times W\leq b\leq W$.

In a preferred embodiment of the liquid storage container according to the present invention, the ejection outlet has an ejection outlet mount portion of a generally elliptic cylindrical shape, mounted to the bag body; and at least a pair of bellows portions, lying adjacent to and on both sides of the ejection outlet mount portion, of the plurality of bellows portions, and optionally the outer bellows portions, lying outside the pair of bellows portions in the width direction, are folded in such a manner that they intersect with a line extending from the long axis of the ellipse of the ejection outlet mount portion.

In a preferred embodiment of the liquid storage container according to the present invention, the pair of bellows portions lying adjacent to and on both sides of the ejection outlet mount portion, is folded in the same direction as viewed from the ejection outlet mount portion.

In a preferred embodiment of the liquid storage container according to the present invention, the width W5 of each of the pair of bellows portions lying adjacent to and on both sides of the ejection outlet mount portion, and the width W6 of each of the outer bellows portions satisfy the relation: $W6/2\geq W5>0$.

The present invention, in yet another aspect, provides a liquid storage container to be housed in an external container having an opening, comprising: a bag body having a top periphery, a bottom periphery and two side peripheries; and an ejection outlet to be attached/detached to/from the opening of the external container and having an ejection outlet mount portion of a generally elliptic cylindrical shape, mounted to the top periphery of the bag body, wherein the bag body has a pair of folded portions formed by folding corner portions between the top periphery and the side peripheries, and includes a plurality of bellows portions formed by accordion-folding the bag body along longitudinally-extending longitudinal crease lines, and wherein the following relation is satisfied:

$$W<b\leq(W0-W3)/2$$

where W0 is the width of the bag body, W3 is the width of the ejection outlet mount portion of the ejection outlet, W is the width of each bellows portion, and b is the width of each folded portion.

In a preferred embodiment of the liquid storage container according to the present invention, one of the pair of triangular folded portions is folded forward, and the other is folded backward.

In a preferred embodiment of the liquid storage container according to the present invention, the bag body has a double-folded portion formed by folding the bag body along an upper lateral crease line and a lower lateral crease line; and the following relations are satisfied:

$$10\%<X/H<50\%, 3\%<Y/H<25\%, X\geq Y$$

where H is the length of the bag body, X is the distance between the top periphery and the lower lateral crease line, and Y is the distance between the upper lateral crease line and the lower lateral crease line.

In a preferred embodiment of the liquid storage container according to the present invention, the top periphery of the bag body includes two heat-sealed portions, the bottom periphery includes a single heat-sealed portion, and the two side peripheries each include a single heat-sealed portion.

The present invention, in yet another aspect, provides an assembly of an external container having an opening, and a liquid storage container housed in the external container, said liquid storage container comprising: a bag body having a top periphery, a bottom periphery and two side peripheries; and an ejection outlet to be attached/detached to/from the opening of the external container and having an ejection outlet mount portion mounted to the top periphery of the bag body, wherein the bag body has a pair of folded portions formed by folding corner portions between the top periphery and the side peripheries, and includes a plurality of bellows portions formed by accordion-folding the bag body along longitudinally-extending longitudinal crease lines, and wherein the following relation is satisfied:

$$W<b\leq(W0-W3)/2$$

where W0 is the width of the bag body, W3 is the width of the ejection outlet mount portion of the ejection outlet, W is the width of each bellows portion, and b is the width of each folded portion.

The present invention, in yet another aspect, provides a method for putting a liquid storage container into an external container having an opening, comprising the steps of: preparing a liquid storage container comprising a bag body having a top periphery, a bottom periphery and two side peripheries, and an ejection outlet having an ejection outlet mount portion mounted to the top periphery of the bag body; folding corner portions between the top periphery and the side peripheries to form a pair of folded portions; accordion-folding the bag body along longitudinally-extending longitudinal crease lines to form a plurality of bellows portions; and putting the liquid storage container into the external container by first inserting the bottom periphery side of the liquid storage container through the opening of the external container, and mounting the ejection outlet to the opening of the external container, wherein the following relation is satisfied:

$$W<b\leq(W0-W3)/2$$

where W0 is the width of the bag body, W3 is the width of the ejection outlet mount portion of the ejection outlet, W is the width of each bellows portion, and b is the width of each folded portion.

The present invention, in yet another aspect, provides a method for filling a liquid using an assembly of an external container having an opening, and a liquid storage container housed in the external container, said liquid storage container comprising: a bag body having a top periphery, a bottom periphery and two side peripheries; and an ejection outlet to be attached/detached to/from the opening of the external container and having an ejection outlet mount portion mounted to the top periphery of the bag body, wherein the bag body has a pair of folded portions formed by folding corner portions between the top periphery and the side peripheries, and includes a plurality of bellows portions formed by accordion-folding the bag body along longitudinally-extending longitudinal crease lines, and wherein the following relation is satisfied:

$$W<b\leq(W0-W3)/2$$

where W0 is the width of the bag body, W3 is the width of the ejection outlet mount portion of the ejection outlet, W is the width of each bellows portion, and b is the width of each folded portion, said liquid filling method comprising the steps of: supplying a gas into the bag body through the ejection outlet of the liquid storage container to inflate the bag body within the external container; and filling a liquid through the ejection outlet into the bag body.

The present invention, in yet another aspect, provides a method for ejecting a liquid using an assembly of an external container having an opening, and a liquid storage container housed in the external container, said liquid storage container comprising: a bag body having a top periphery, a bottom periphery and two side peripheries; and an ejection outlet to be attached/detached to/from the opening of the external container and having an ejection outlet mount portion mounted to the top periphery of the bag body, wherein the bag body has a pair of folded portions formed by folding corner portions between the top periphery and the side peripheries, and includes a plurality of bellows portions formed by accordion-folding the bag body along longitudinally-extending longitudinal crease lines, and wherein the following relation is satisfied:

$$W<b\leq(W0-W3)/2$$

where W0 is the width of the bag body, W3 is the width of the ejection outlet mount portion of the ejection outlet, W is the width of each bellows portion, and b is the width of each folded portion, said liquid ejecting method comprising the step of ejecting a liquid, which fills the bag body, from the ejection outlet.

Advantageous Effects of the Invention

According to the present invention, the liquid storage container, which has been inserted into the external container, can be securely inflated.

DESCRIPTION OF THE PREFERRED EMBODIMENTS

First Embodiment

A first embodiment of the present invention will now be described with reference to the drawings.

Figure 1:
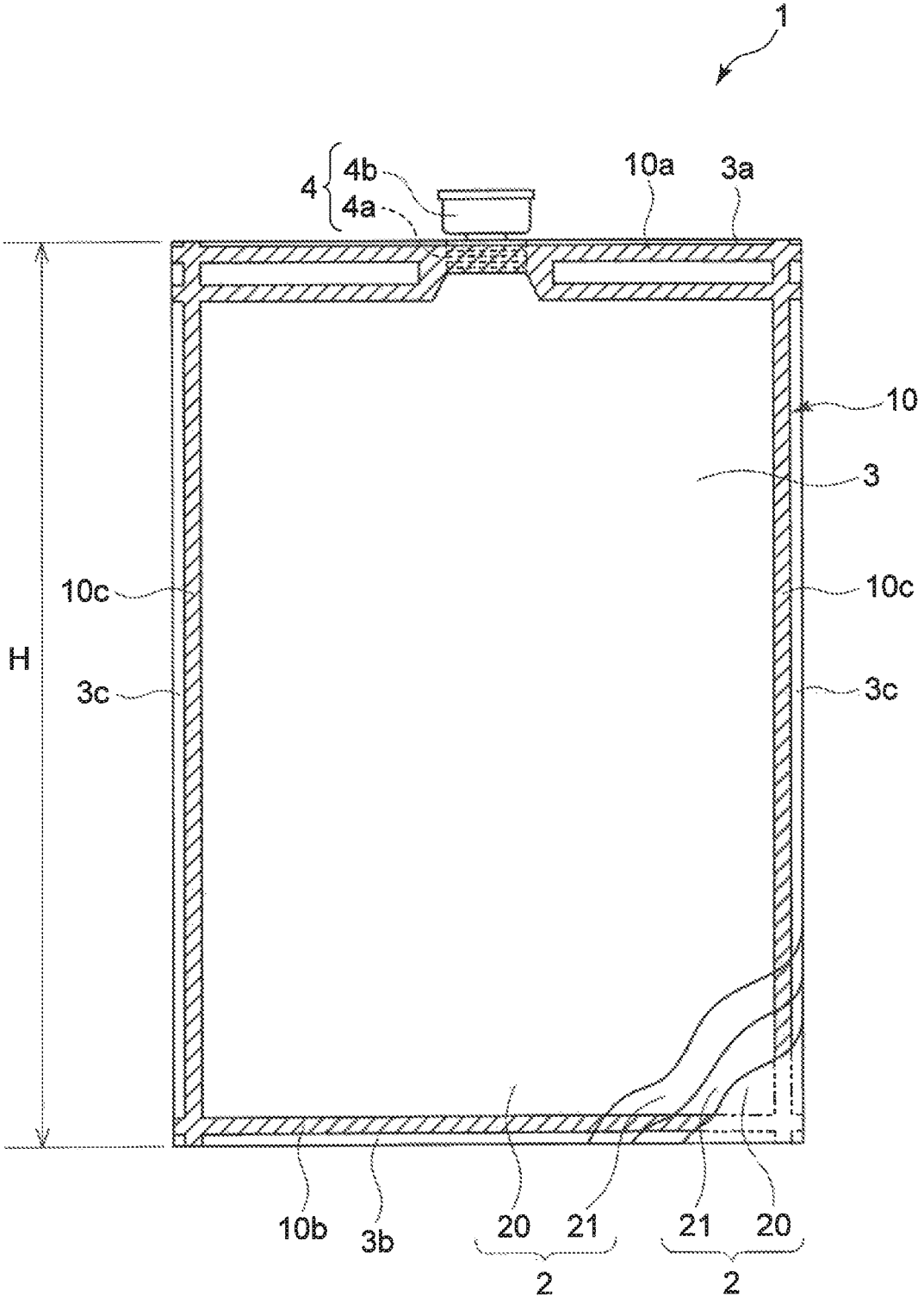
FIG. 1 is a plan view of a liquid storage container according to the present invention.
Figure 2A:
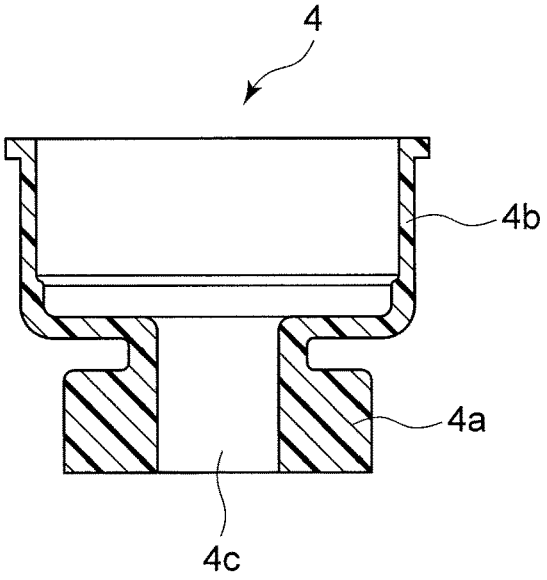
FIG. 2A is a cross-sectional view of the ejection outlet of the liquid storage container.
Figure 2B:
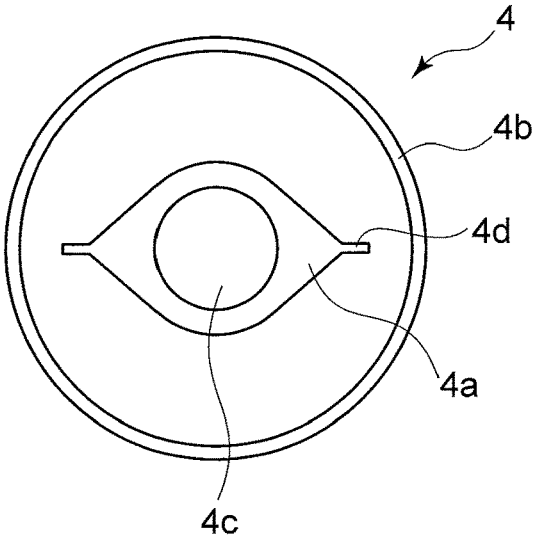
FIG. 2B is a bottom view of the ejection outlet.
Figure 3:
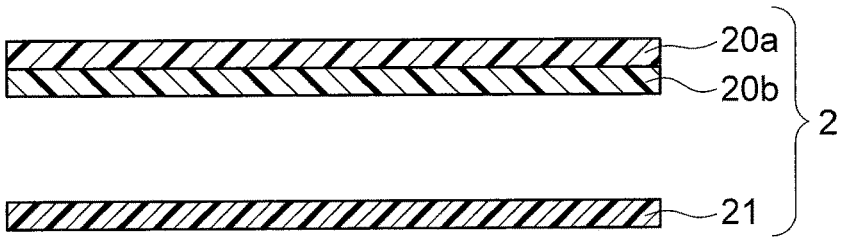
FIG. 3 is a cross-sectional view showing the layer construction of the bag body of the liquid storage container.

FIG. 1 is a plan view of a liquid storage container according to the first embodiment; FIG. 2A is a vertical cross-sectional view of an ejection outlet, and FIG. 2B is a bottom view of the ejection outlet as viewed from the side of an ejection outlet mount portion; and FIG. 3 is a schematic view showing the layer construction of an outer bag and an inner bag which are used for the bag body of the liquid storage container.

The liquid storage container 1 of this embodiment includes a bag body 3, produced by superimposing two multi-layer films 2, each comprising a laminate of an outer bag 20 and an inner bag 21, on each other such that the inner bags 21 of the films 2 face each other, and heat-sealing the four sides of the superimposed films to form a heat-sealed portion 10, and an ejection outlet 4 disposed at the top periphery 3*a* of the bag body 3 and fusion-bonded to the inner bags 21.

Though in this embodiment the bag body 3 is obtained by superimposing the multi-layer films 2 on each other such that the inner bags 21 of the films 2 face each other, and heat-sealing the four sides of the superimposed films to form the heat-sealed portion 10, the present invention is not limited to this method. For example, it is possible to fold three peripheral sides of the multi-layer films 2 such that the inner bags 21 of the films 2 face each other, and heat-seal the overlapping three sides. The heat-sealed portion 10 may have arc-shaped corners so that fluid contents are less likely to remain in the corners. The bag body 3 needs not necessarily be composed of a multi-layer film; the film construction of the bag body 3 can be arbitrarily determined depending on the contents and their amount.

As described above, the bag body 3 is obtained by superimposing the two multi-layer films 2 on each other, and heat-sealing the periphery of the superimposed films to form the heat-sealed portion 10. The bag body 3 has a rectangular shape having a top periphery 3*a*, a bottom periphery 3*b* and two side peripheries 3*c*, 3*c*. The top periphery 3*a* includes two top periphery heat-sealed portions 10*a*, the bottom periphery 3*b* includes a single bottom periphery heat-sealed portion 10*b*, and each side periphery 3*c*, 3*c* includes a single side periphery heat-sealed portion 10*c*. The top periphery heat-sealed portions 10*a*, the bottom periphery heat-sealed portion 10*b* and the side periphery heat-sealed portions 10*c* constitute the heat-sealed portion 10.

As described above, the top periphery 3*a* of the bag body 3 includes the two top periphery heat-sealed portions 10*a*. Compared to the case of forming a single heat-sealed portion, having a width equal to the sum of the widths of the two top periphery heat-sealed portions 10*a*, in the top periphery 3*a*, the provision of the two top periphery heat-sealed portions 10*a* according to this embodiment can make the top periphery 3*a* relatively flexible.

The ejection outlet 4 consists of an ejection outlet mount portion 4*a* and an ejection outlet engagement portion 4*b* connecting with the ejection outlet mount portion 4*a* and, in the ejection outlet mount portion 4*a*, is fusion-bonded to the inner bags 21 of the multi-layer films 2 as shown in FIG. 1.

As shown in FIGS. 2A and 2B, the ejection outlet mount portion 4*a* of the ejection outlet 4 has a flattened shape and has a central through-hole 4*c*.

In general, when fusion-bonding the ejection outlet mount portion 4*a* of the ejection outlet 4 to the inner bags 21 of the multi-layer films 2, spaces are likely to be formed in two regions surrounded by the inner bags 21 and the side ends of the ejection outlet mount portion 4*a*, resulting in poor sealing of the ejection outlet mount portion 4*a*. In view of this, a pair of plate-like ribs 4*d* is provided at the side ends of the ejection outlet mount portion 4*a*. Upon fusion-bonding of the ejection outlet mount portion 4*a*, the plate-like ribs 4*d* are allowed to melt, which can prevent the formation of spaces around the side ends of the ejection outlet mount portion 4*a*. The ejection outlet mount portion 4*a* may have an elliptic cylindrical shape.

The ejection outlet 4 is preferably produced by injection molding. There is no particular limitation on a resin to be used as long as it is injection moldable. However, since the ejection outlet 4 is to be fusion-bonded to the interior surfaces of the inner bags 21 of the multi-layer films 2, the resin for the ejection outlet 4 needs to be appropriately selected depending on the type of the resin of the interior surfaces of the inner bags 21. A high-density polyethylene resin, which remains rigid at high temperatures and hardly becomes brittle at low temperatures, may be preferably used.

The multi-layer film 2, constituting the bag body 3, will now be described. In this embodiment the multi-layer film 2 is composed of a film constituting the outer bag 20 and a film constituting the inner bag 21.

As shown in FIG. 3, a laminate of unstretched nylon (thickness 20 μm) 20*a*/linear low-density polyethylene (thickness 40 μm) 20*b* can be used as the outer bag 20 of the bag body 3, while a linear low-density polyethylene (thickness 70 μm) can be used as the inner bag 21.

The inclusion of the unstretched nylon 20*a* in the outer bag 20 can increase the elongation of the outer bag 20. For example, the outer bag 20 has an elongation of 300% to 500%. The high elongation of the outer bag 20 can make the bag body 3 flexible as a whole. Therefore, when inserting the bag body 3 into an external container 5, and inflating the bag body 3 within the external container 5 by supplying nitrogen gas into the bag body 3 as described below, the bag body 3 can be inflated smoothly.

The material and the layer construction of the bag body 3 are not limited to those described above. For example, the inner bag 21 may have a laminate structure. The outer bag 20 may have a three-layer laminate structure.

Examples of materials usable for the inner bag 21 include low-density polyethylene, a mixture of low-density polyethylene and linear low-density polyethylene, polypropylene, and a fluorine-containing resin.

Examples of materials usable for the outer bag 20 include nylon, polyethylene terephthalate, polybutylene terephthalate, a fluorine-containing resin, and a material having an elongation of 300% to 500%, such as a mixture of low-density polyethylene and linear low-density polyethylene.

The shape of the bag body 3 will now be described further. As shown in FIGS. 4 through 7, the bag body 3 comprises a plurality of, for example five, bellows portions formed by accordion-folding the bag body 3 along a plurality of, for example four, longitudinal crease lines 11 (see FIGS. 4A through 4C and FIG. 5).

The bellows portions 12 of the bag body 3 have approximately the same width W. The ejection outlet 4 mounted to the bag body 3 is disposed on the middle one of the five bellows portions 12. In the liquid storage container 1 shown in FIGS. 4A through 4C and FIG. 5, a bottom folded portion 17 may be provided by folding a lower portion of the bag body 3.

Figure 6:
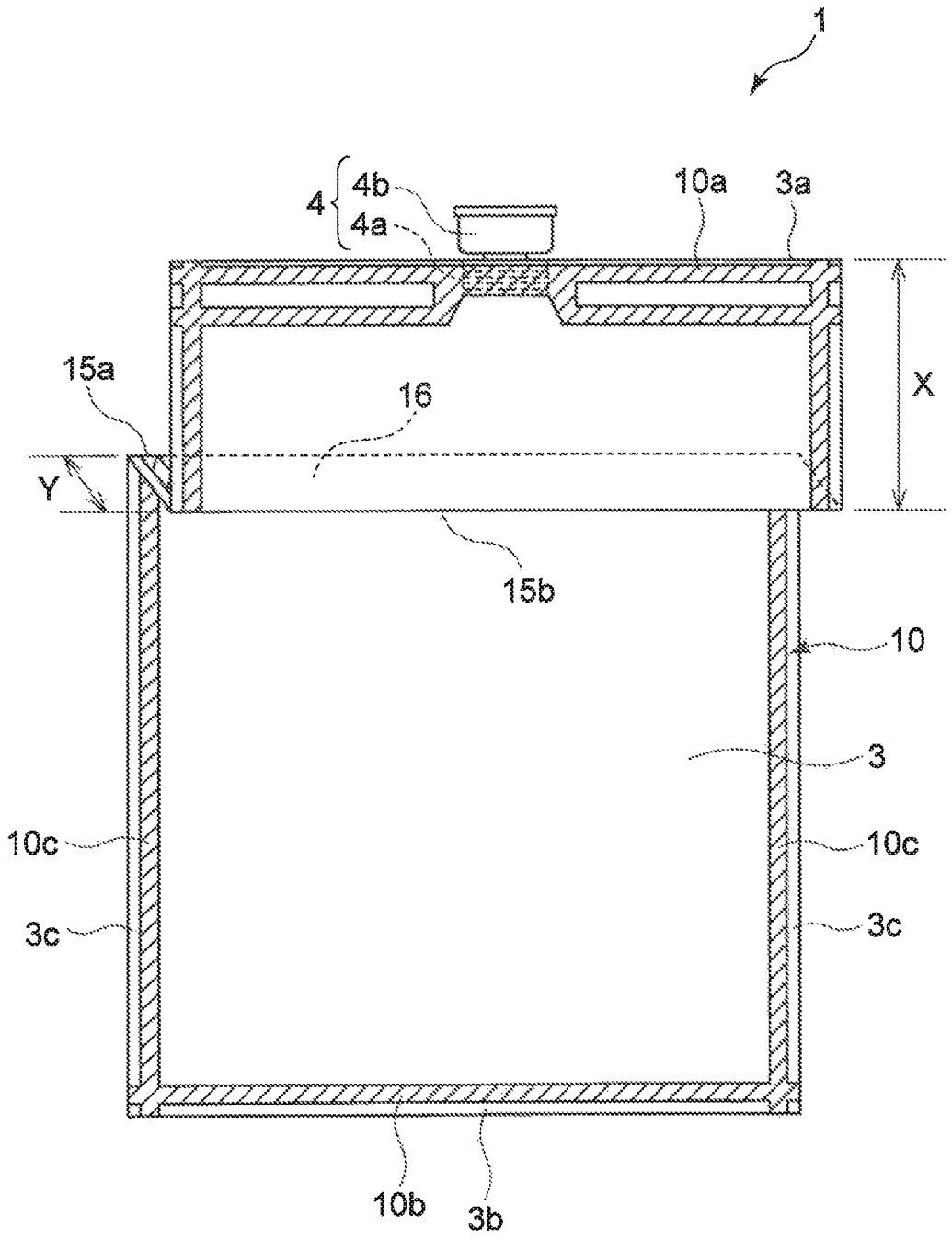
FIG. 6 is a diagram showing the liquid storage container when the bag body is folded along an upper lateral crease line and a lower lateral crease line.

After forming the five bellows portions 12 by folding the bag body 3 along the longitudinal crease lines 11, the bag body 3 is folded along an upper lateral crease line 15*a* and a lower lateral crease line 15*b* to form a laterally-extending double-folded portion 16 (see FIG. 6).

Figure 4A:
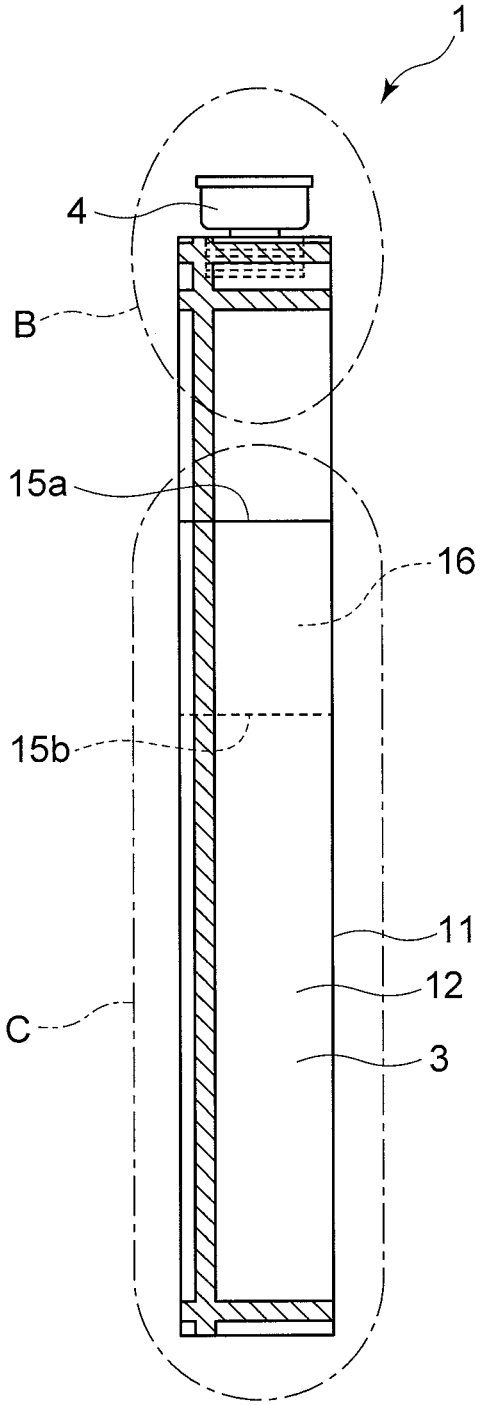
FIG. 4A is a diagram showing the liquid storage container in a folded state.
Figure 4B:
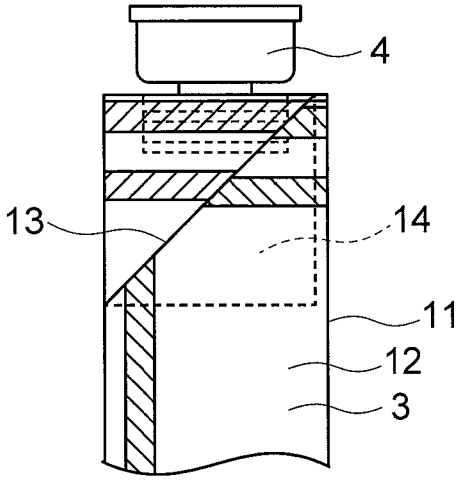
FIG. 4B is an enlarged view of the portion B of FIG. 4A.
Figure 4C:
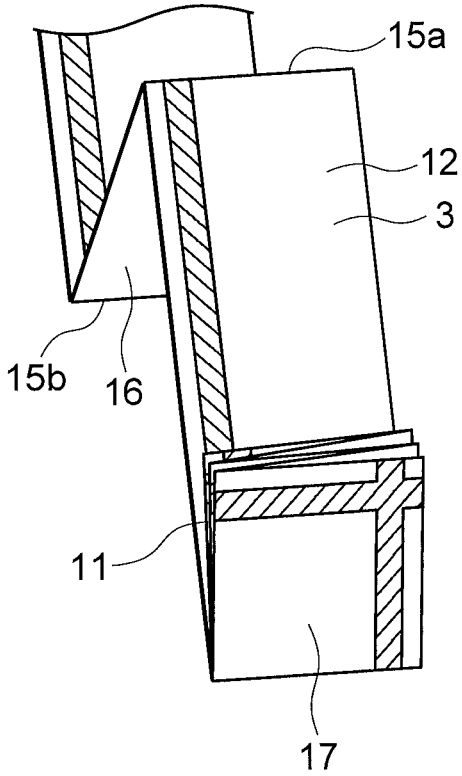
FIG. 4C is an enlarged view of the portion C of FIG. 4A.
Figure 5:
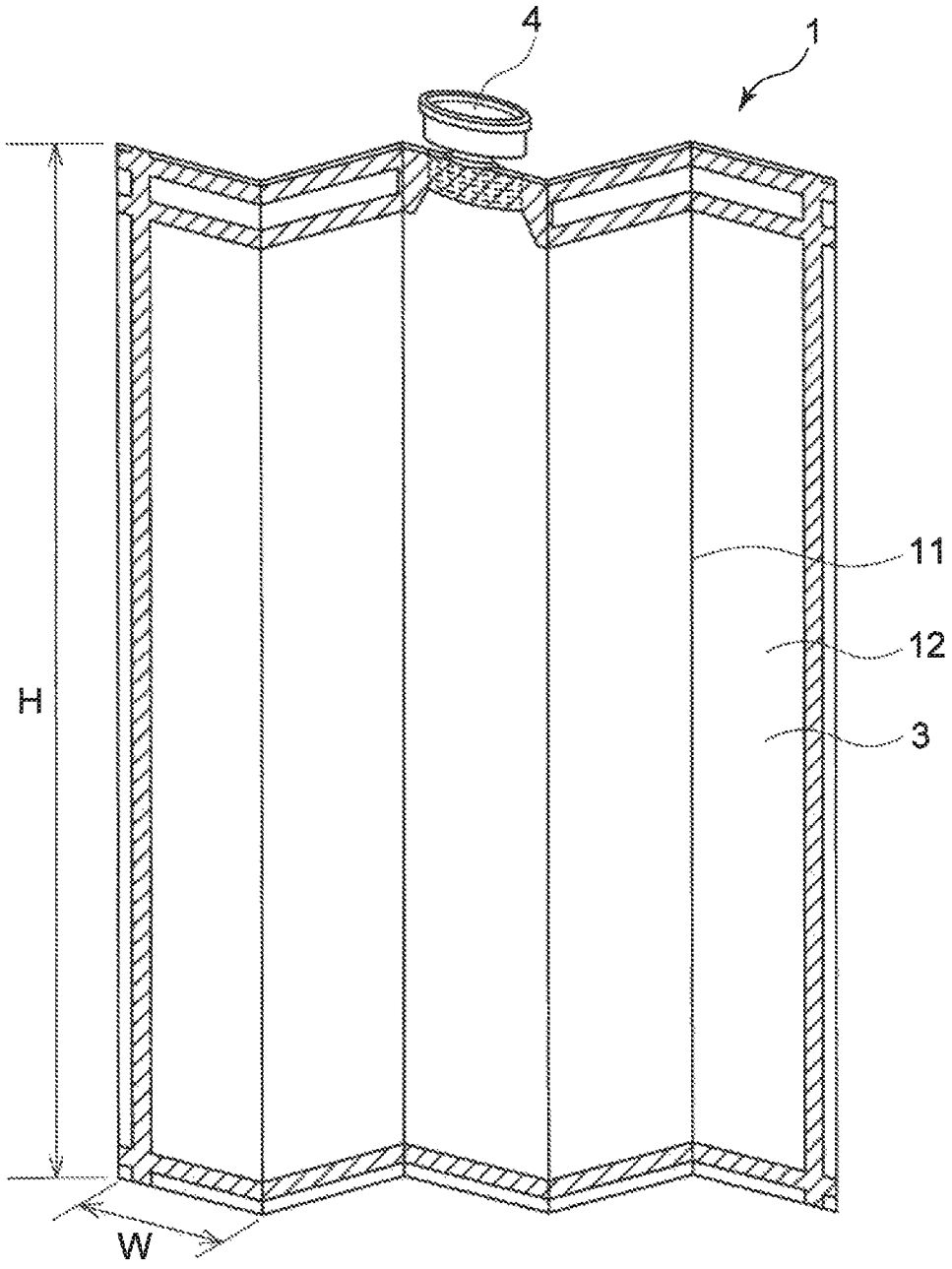
FIG. 5 is a diagram showing the liquid storage container when the bag body is accordion-folded along longitudinal crease lines.

Referring to FIGS. 4 through 6, it is preferred that the following relations be satisfied:

$$10\% < X/H < 50\%, 3\% < Y/H < 10\%$$

where H is the length of the bag body 3 before folding, X is the distance between the top periphery 3*a* of the bag body 3 and the lower lateral crease line 15*b*, and Y is the distance between the upper lateral crease line 15*a* and the lower lateral crease line 15*b* (the height of the double-folded portion 16).

By making the ratio X/H lower than 50%, the double-folded portion 16 can be formed in an upper portion of the bag body 3. This can increase the weight of the portion of the bag body 3 which lies under the double-folded portion 16. After inserting the liquid storage container 1 into an external container 5, the portion of the bag body 3, lying under the double-folded portion 16, is allowed to securely fall by its own weight. Therefore, the liquid storage container 1 can be securely inflated within the external container 5.

By making the ratio X/H higher than 10%, the double-folded portion 16 having a sufficient length Y can be securely formed.

By making the ratio Y/H higher than 3%, the double-folded portion 16 having a sufficient length Y can be formed. On the other hand, by making the ratio Y/H lower than 10%, a large portion of the bag body 3, lying under the double-folded portion 16, can be ensured; the portion of the bag body 3, lying under the double-folded portion 16, is allowed to securely fall by its own weight.

Figure 7:
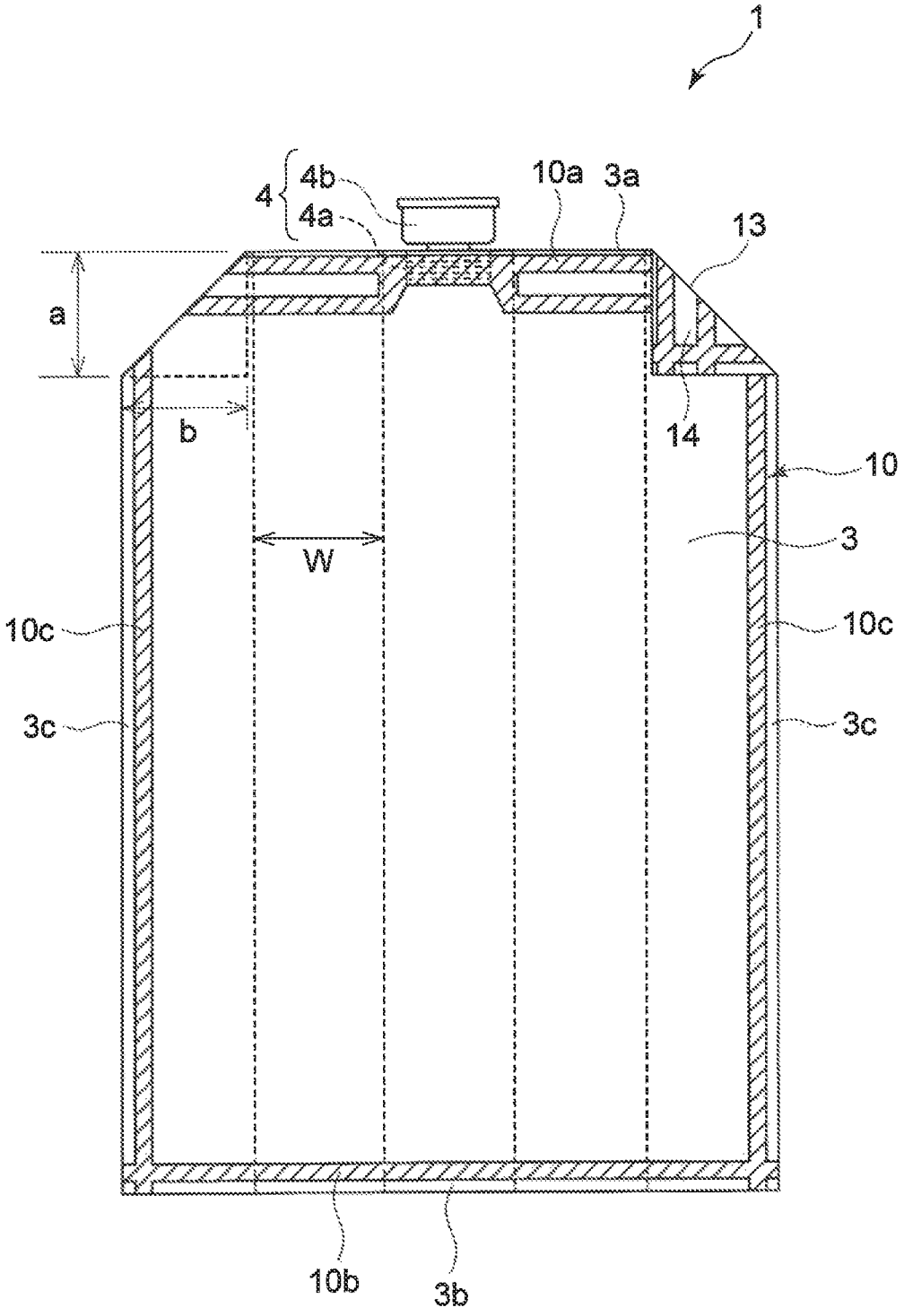
FIG. 7 is a diagram showing triangular folded portions each formed by folding the bag body of the liquid storage container along a crease line.

After forming the bellows portions 12 by folding the bag body 3 along the longitudinal crease lines 11, and forming the double-folded portion 16 by folding the bag body 3 along the upper lateral crease line 15*a* and the lower lateral crease line 15*b*, triangular folded portions 14 are formed by folding the bag body 3 along crease lines 13 extending between the top periphery 3*a* and the side peripheries 3*c*, 3*c* (see FIG. 7). While the pair of triangular folded portions 14, 14 is formed in the case where the upper corners of the bag body 3 are right-angled corners, a pair of arc-shaped folded portions is to be formed in the case where the upper corners of the bag body 3 are arc-shaped corners. The triangular folded portions 14, 14 and such arc-shaped folded portions may collectively be referred to herein as folded portions. While the triangular folded portions 14, 14 are illustrated in this embodiment, the present invention is not limited to triangular folded portions; arc-shaped folded portions or other shapes of folded portions may also be used.

Either the step of forming the bellows portions 12 by folding the bag body 3 along the longitudinal crease lines 11, or the step of forming the laterally-extending double-folded portion 16 by folding the bag body 3 along the upper lateral crease line 15*a* and the lower lateral crease line 15*b* may be performed first.

When inserting the liquid storage container 1 through an opening 5*a* into an external container 5 and inflating the bag body 3 by supplying nitrogen gas into the liquid storage container 1, the triangular folded portions 14 can prevent the corner portions between the top periphery 3*a* and the side peripheries 3*c*, 3*c* from sticking in the opening 5*a* of the external container 5, thereby preventing damage to the bag body 3, or preventing the bag body 3 from being insufficiently inflated and failing to obtain sufficient flexibility.

Referring to FIG. 7, the following relations are satisfied:

$$3\% < a/H < 20\%, \tfrac{1}{2} \times W \leq b \leq W$$

where a and b are the length and the width, respectively, of each triangular folded portion 14 of the bag body 3, H is the length of the bag body 3, and W is the width of each bellows portion 12. The length a of each triangular folded portion 14 refers to the distance from the point of intersection between a line extending from the top periphery 3*a* of the bag body 3 and a line extending from the side periphery 3*c* of the bag body 3 to the folding start position on the side periphery 3*c* of the triangular folded portion 14. The width b of each triangular folded portion 14 refers to the distance from the point of intersection between a line extending from the top periphery 3*a* of the bag body 3 and a line extending from the side periphery 3*c* of the bag body 3 to the folding start position on the top periphery 3*a* of the triangular folded portion 14.

If the ratio a/H is higher than 20%, the triangular folded portions 14, formed by folding the bag body 3 along the crease lines 13, each do not lie within the bellows portion 12. If the ratio a/H is lower than 3%, the bag body 3 can stick in the opening 5*a* of the external container 5 when inserting the liquid storage container 1 into the external container 5.

By making the width b of each triangular folded portion 14 satisfy the relation: $\tfrac{1}{2} \times W \leq b \leq W$, the triangular folded portions 14 each can be made to securely lie within the bellows portion 12 having the width W.

Preferably, each triangular folded portion 14 has a generally isosceles right triangular shape with a=b.

In the above-described embodiment, each triangular folded portion 14 is formed by folding the top periphery 3*a*-side corner of the single bellows portion 12 on the side of the side periphery 3*c* of the bag body 3. However, each triangular folded portion 14 may be formed by folding the top periphery 3*a*-side corner of a plurality of, for example two, bellows portions 12 on the side of the side periphery 3*c* of the bag body 3.

While the bellows portions 12, formed by accordion-folding the bag body 3 along the longitudinal crease lines 11, are shown in FIG. 5, the double-folded portion 16 is not shown in FIG. 5 for the sake of illustration.

While the double-folded portion 16, formed by folding the bag body 3 along the upper lateral crease line 15*a* and the lower lateral crease line 15*b*, is shown in FIG. 6, the bellows portions 12 are not shown in FIG. 6 for the sake of illustration.

While the triangular folded portions 14, formed by folding the bag body 3 along the crease lines 13, are shown in FIG. 7, the bellows portions 12 and the double-folded portion 16 are not shown in FIG. 7 for the sake of illustration.

The bellows portions 12 need not necessarily have the same width W, i.e. the bellows portions 12 may have different widths W. In that case, the following relation is satisfied: $\tfrac{1}{2} \times W_R \leq b_R \leq W_R$, where $b_R$ is the width of the right triangular folded portion 14 of the pair of triangular folded portions 14, 14 of the bag body 3, and $W_R$ is the width of the rightmost bellows portion 12, including the right side periphery heat-sealed portion 10*c*, of the bellows portions 12 of the bag body 3. Further, the following relation is satisfied: $\tfrac{1}{2} \times W_L \leq b_L \leq W_L$, where $b_L$ is the width of the left triangular folded portion 14 of the pair of triangular folded portions 14, 14 of the bag body 3, and $W_L$ is the width of the leftmost bellows portion 12, including the left side periphery heat-sealed portion 10*c*, of the bellows portions 12 of the bag body 3.

The operation of the thus-constructed liquid storage container 1 according to this embodiment will now be described.

At the outset, the bellows portions 12 are formed by folding the bag body 3 of the liquid storage container 1 along the longitudinal crease lines 11. Next, the double-folded portion 16 is formed by folding the bag body 3 along the upper lateral crease line 15*a* and the lower lateral crease line 15*b*. Thereafter, the triangular folded portions 14 are formed by folding the bag body 3 along the crease lines 13.

The liquid storage container 1, having the bellows portions 12, the double-folded portion 16 and the triangular folded portions 14, is thus prepared as shown in FIGS. 4A and 4B.

Figure 8A:
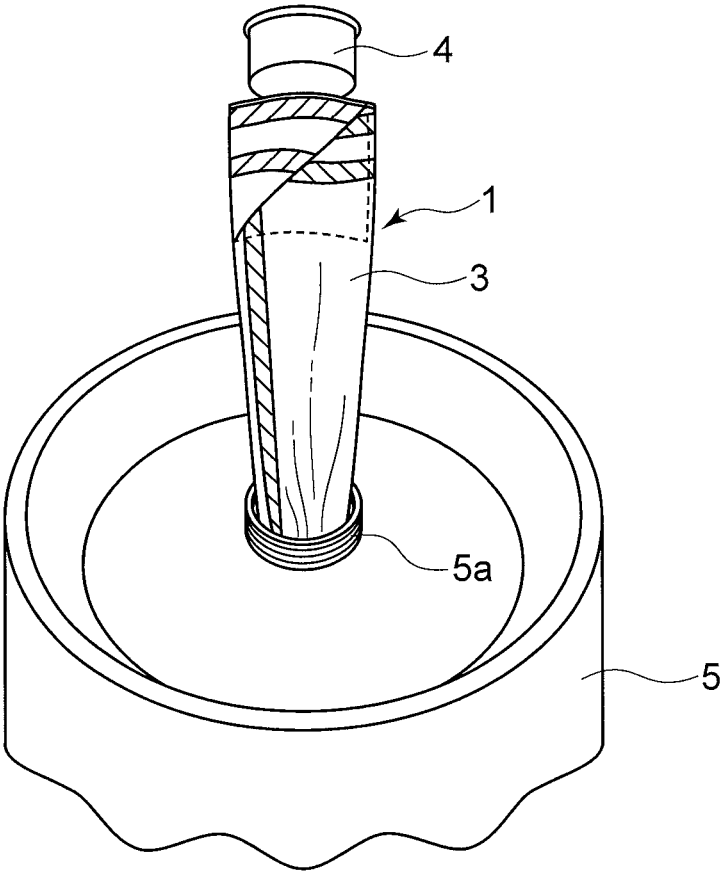
FIGS. 8A and 8B are diagrams illustrating insertion of the liquid storage container into an external container.
Figure 8B:
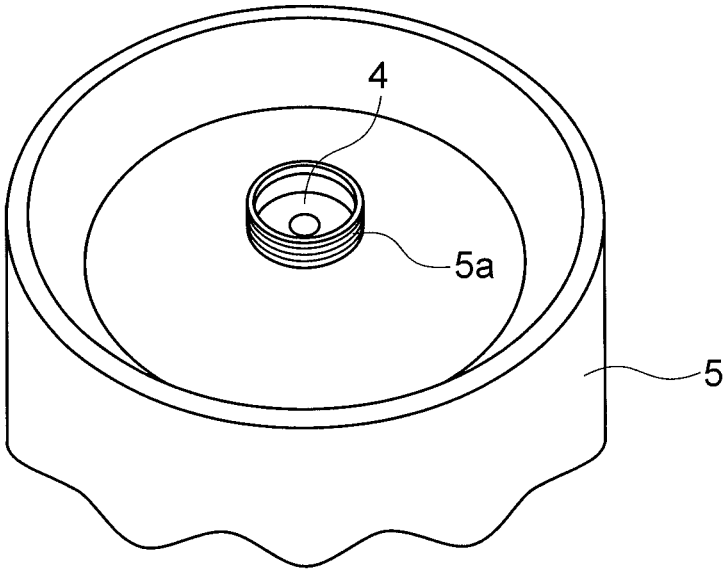

Next, as shown in FIG. 8A, the liquid storage container 1 is further folded longitudinally into a longitudinally elongated shape, and is inserted through the opening 5*a* into the external container 5.

Next, the ejection outlet 4 of the liquid storage container 1 is mounted in the opening 5*a* of the external container 5 by engagement of the ejection outlet engagement portion 4*b* with the opening 5*a* of the external container 5.

Next, nitrogen gas is supplied through the ejection outlet 4 into the liquid storage container 1, thereby inflating the bag body 3 of the liquid storage container 1 within the external container 5.

After thus inflating the bag body 3 with nitrogen gas, liquid contents can be filled into the liquid storage container 1.

The operation for inflating the liquid storage container 1 within the external container 5 will now be described further.

After the liquid storage container 1 is inserted into the external container 5, the portion of the bag body 3, lying under the double-folded portion 16, falls by its own weight, whereby the bag body 3 expands.

Next, the bag body 3 is inflated by supplying nitrogen gas into the liquid storage container 1. With the supply of the gas, the bag body 3, which has been accordion-folded along the longitudinal crease lines 11, expands into a planar configuration.

Since the triangular folded portions 14, formed by folding the bag body 3 along the crease lines 13, are provided in the upper portions of the bag body 3, the corner portions of the top periphery 3*a* of the bag body 3 do not stick in the opening 5*a* of the external container 5 when the bag body 3 expands. This can prevent damage to the bag body 3, or prevent the bag body 3 from being insufficiently inflated and failing to obtain a sufficient interior volume.

Since the top periphery 3*a* of the bag body 3 includes the two top periphery heat-sealed portions 10*a*, the top periphery 3*a* can be made relatively flexible as compared to the case of providing a single wide heat-sealed portion. The bag body 3 can therefore be expanded more smoothly within the external container 5. Further, when the outer bag 20 has an elongation of 300% to 500%, the bag body 3 can have increased flexibility. This facilitates the operation of expanding the bag body 3.

The outer bag 20, however, may have an elongation of less than 300% or an elongation of more than 500%.

In the case where the double-folded portion 16 is formed after the formation of the bellows portions 12 as described above, the portion of the bag body 3, lying under the double-folded portion 16, first falls by its own weight in the external container 5 after the bag body 3 is put into the external container 5, and the fold of the bellows portions 12 loosens. Thereafter, the bag body 3 is inflated and the bellows portions 12 are expanded into a planar configuration by the supply of nitrogen gas into the bag body 3.

On the other hand, in the case where the bellows portions 12 are formed after the formation of the double-folded portion 16, the fold of the bellows portions 12 first loosens into a somewhat planar configuration after the bag body 3 is put into the external container 5. At this point of time, the double-folded portion 16 has not fallen yet. Thereafter, by the supply of nitrogen gas into the bag body 3, the portion of the bag body 3 which lies closer to the ejection outlet 4 than the double-folded portion 16 is inflated and, at the same time, the bellows portions 12 are expanded into a planar configuration. As the bellows portions 12 thus become planar, the portion of the bag body 3, lying under the double-folded portion 16, falls by its own weight in the external container 5, and then the portion under the lower lateral crease line 15*b* inflates.

EXAMPLES

Example 1

Example 1 according to the first embodiment will now be described.

First, a liquid storage container 1 having an interior volume of 20.8 L before folding was prepared.

Next, the bag body 3 of the liquid storage container 1 was folded in the above-described manner: Bellows portions 12 were formed by accordion-folding the bag body 3 along longitudinal crease lines 11, and then a double-folded portion 16 was formed by folding the bag body 3 along an upper lateral crease line 15*a* and a lower lateral crease line 15*b*. Further, triangular folded portions 14 were formed between the top periphery 3*a* and the two side peripheries 3*c* of the bag body 3 by folding the bag body 3 along crease lines 13.

The length H of the bag body 3 is 660 mm, the distance X between the top periphery 3*a* and the lower lateral crease line 15*b* is 160 mm, and the distance Y between the upper lateral crease line 15*a* and the lower lateral crease line 15*b* is 50 mm. The width W of each bellows portion 12 is 100 mm.

The length a of each triangular folded portion 14 is 100 mm, and the width b of each triangular folded portion 14 is 100 mm.

The thus-constructed liquid storage container 1 was inserted through an opening 5*a* into an external container 5. Thereafter, nitrogen gas was supplied into the liquid storage container 1 in the external container 5 to inflate the bag body 3 of the liquid storage container 1. The interior volume of the liquid storage container 1 was found to be 20.2 L.

The interior volume value of the liquid storage container 1 is the average in three tests.

Next, Comparative Example was conducted in the following manner. The same unfolded liquid storage container 1 as used in Example 1 was prepared. The liquid storage container 1 was folded and inserted into the external container 5.

The folded liquid storage container 1 of Comp. Example has the following configuration.

The comparative folded liquid storage container has the same configuration as the folded container of Example 1 except that the distance X was 425 mm and the distance Y was 117.5 mm in the comparative folded container.

The thus-constructed liquid storage container 1 was inserted through the opening 5*a* into the external container 5, and then nitrogen gas was supplied into the liquid storage container 1 to inflate the bag body 3.

The interior volume of the liquid storage container 1 was found to be 17.7 L.

The interior volume value of the comparative liquid storage container 1 is the average in three tests.

The test results demonstrate that the liquid storage container 1 of Example 1 inflates smoothly in the external container 5, and that the liquid storage container 1 in the external container 5 has approximately the same interior volume as the unfolded liquid storage container 1.

Example 2

Example 2 according to the first embodiment will now be described.

Example 2-1

First, a liquid storage container 1 having an interior volume of 20.8 L before folding was prepared.

Next, the bag body 3 of the liquid storage container 1 was folded in the above-described manner: A double-folded portion 16 was formed by folding the bag body 3 along an upper lateral crease line 15*a* and a lower lateral crease line 15*b*, and then bellows portions 12 were formed by accordion-folding the bag body 3 along longitudinal crease lines 11. Further, triangular folded portions 14 were formed between the top periphery 3*a* and the two side peripheries 3*c* of the bag body 3 by folding the bag body 3 along crease lines 13.

The length H of the bag body 3 is 660 mm, the distance X between the top periphery 3*a* and the lower lateral crease line 15*b* is 160 mm, and the distance Y between the upper lateral crease line 15*a* and the lower lateral crease line 15*b* is 50 mm. The width W of each bellows portion 12 is 100 mm.

The length a of each triangular folded portion 14 is 100 mm, and the width b of each triangular folded portion 14 is 100 mm.

The thus-constructed liquid storage container 1 was inserted through the opening 5*a* into the external container 5. Thereafter, nitrogen gas was supplied into the liquid storage container 1 in the external container 5 at a flow rate of 80 L/min for 90 seconds to inflate the bag body 3 of the liquid storage container 1. Thereafter, the external container 5, housing therein the inflated liquid storage container 1, was put on a weight scale while venting the internal pressure to measure the tare. Thereafter, water was supplied to the liquid storage container 1; and the interior volume of the liquid storage container 1 was determined by the difference in the weight of the liquid storage container 1 before and after the supply of water. The interior volume of the liquid storage container 1 was found to be 20.1 L.

The interior volume value of the liquid storage container 1 is the average in three tests.

Example 2-2

The liquid storage container 1 was folded in the same manner as in Example 2-1 except that the triangular folded portions 14 were not provided.

The interior volume of the liquid storage container 1 was found to be 20.0 L.

Example 2-3

The liquid storage container 1 was folded in the same manner as in Example 2-1 except that the triangular folded portions 14 were not provided, and that the values of X and Y were changed.

The interior volume of the liquid storage container 1 was found to be 20.0 L.

Example 2-4

The liquid storage container 1 was folded in the same manner as in Example 2-1 except that the triangular folded portions 14 were not provided, and that the values of X and Y were changed.

The interior volume of the liquid storage container 1 was found to be 19.8 L.

Example 2-5

The liquid storage container 1 was folded in the same manner as in Example 2-1 except that the triangular folded portions 14 were not provided, and that the values of X and Y were changed.

The interior volume of the liquid storage container 1 was found to be 20.0 L.

Example 2-6

The liquid storage container 1 was folded in the same manner as in Example 2-1 except that the triangular folded portions 14 were not provided, and that the values of X and Y were changed.

The interior volume of the liquid storage container 1 was found to be 20.1 L.

Example 2-7

The liquid storage container 1 was folded in the same manner as in Example 2-1 except that the triangular folded portions 14 were not provided, and that the values of X and Y were changed.

The interior volume of the liquid storage container 1 was found to be 20.1 L.

Example 2-8

The liquid storage container 1 was folded in the same manner as in Example 2-1 except that the value of a was changed.

The interior volume of the liquid storage container 1 was found to be 20.2 L.

Example 2-9

The liquid storage container 1 was folded in the same manner as in Example 2-1 except that the value of a was changed.

The interior volume of the liquid storage container 1 was found to be 20.1 L.

Example 2-10

The liquid storage container 1 was folded in the same manner as in Example 2-1 except that the value of b was changed.

The interior volume of the liquid storage container 1 was found to be 20.1 L.

Example 2-11

The liquid storage container 1 was folded in the same manner as in Example 2-1 except that the triangular folded portions 14 were each formed by folding two side periphery 3*c*-side bellows portions 12.

The interior volume of the liquid storage container 1 was found to be 20.1 L.

Comp. Examples 2-1 to 2-5

In each of Comp. Examples 2-1 to 2-5, the liquid storage container 1 was folded in the same manner as in Example 2-1 except that the triangular folded portions 14 were not provided, and that the values of X and Y were changed.

The interior volumes of the liquid storage containers 1 of Comp. Examples 2-1 to 2-5 were found to be 18.5 L, 18.9 L, 19.3 L, 19.1 L and 19.3 L, respectively.

The dimensions and the interior volumes of the liquid storage containers 1 of Examples 2-1 to 2-11 and Comp. Examples 2-1 to 2-5 are shown in Table-1 and Table-2 below.

As shown in Table-1 and Table-2, the interior volumes of the liquid storage containers 1 of Examples 2-1 to 2-11 are larger than those of Comp. Examples 2-1 to 2-5. The interior volumes of the liquid storage containers 1 of Comp. Examples 2-1 to 2-5 are smaller by more than 5% than the interior volume of the unfolded liquid storage container 1, namely 20.8 L. On the other hand, the decreases in the interior volumes of the liquid storage containers 1 of Examples 2-1 to 2-11 are all less than 5%. The test results thus demonstrate that the liquid storage containers 1 of Examples 2-1 to 2-11 can be sufficiently inflated within the external container 5.

TABLE 1

| | | Examples | | | | | | | | | | |
|---|---|---|---|---|---|---|---|---|---|---|---|---|
| | | 2-1 | 2-2 | 2-3 | 2-4 | 2-5 | 2-6 | 2-7 | 2-8 | 2-9 | 2-10 | 2-11 |
| Shape of bag body (mm) | Height H | 660 | 660 | 660 | 660 | 660 | 660 | 660 | 660 | 660 | 660 | 660 |
| | Width 5W | 500 | 500 | 500 | 500 | 500 | 500 | 500 | 500 | 500 | 500 | 500 |
| Crease lines (mm) | X | 160 | 160 | 320 | 320 | 320 | 70 | 70 | 160 | 160 | 160 | 160 |
| | Y | 50 | 50 | 60 | 20 | 35 | 60 | 20 | 50 | 50 | 50 | 50 |
| Triangular folded Portion (mm) | a | 100 | 0 | 0 | 0 | 0 | 0 | 0 | 130 | 20 | 100 | 100 |
| | b | 100 | 0 | 0 | 0 | 0 | 0 | 0 | 100 | 100 | 50 | 100 |
| Volume (L) | Average | 20.2 | 20.0 | 20.0 | 19.8 | 20.0 | 20.1 | 20.1 | 20.2 | 20.1 | 20.1 | 20.1 |
| | First | 20.7 | 20.2 | 19.7 | 19.7 | 19.9 | 20.1 | 20.0 | 20.1 | 19.9 | 20.1 | 20.1 |
| | Second | 19.9 | 20.0 | 20.2 | 19.8 | 19.9 | 20.2 | 20.1 | 20.2 | 19.8 | 19.9 | 20.0 |
| | Third | 20.1 | 19.9 | 20.0 | 19.8 | 20.1 | 20.1 | 20.1 | 20.2 | 20.3 | 20.2 | 20.2 |

TABLE 2

| | | Comp. Examples | | | | |
|---|---|---|---|---|---|---|
| | | 2-1 | 2-2 | 2-3 | 2-4 | 2-5 |
| Shape of bag body (mm) | Height H | 660 | 660 | 660 | 660 | 660 |
| | Width 5W | 500 | 500 | 500 | 500 | 500 |
| Crease lines (mm) | X | 425 | 160 | 160 | 425 | 50 |
| | Y | 117.5 | 117.5 | 15 | 50 | 50 |
| Triangular folded portion (mm) | a | 0 | 0 | 0 | 0 | 0 |
| | b | 0 | 0 | 0 | 0 | 0 |
| Volume (L) | Average | 18.5 | 18.9 | 19.3 | 19.1 | 19.3 |
| | First | 18.5 | 19.1 | 19.7 | 19.2 | 19.5 |
| | Second | 18.2 | 18.7 | 19.1 | 19.0 | 19.0 |
| | Third | 18.7 | 19.0 | 19.2 | 19.1 | 19.3 |

Second Embodiment

A second embodiment will now be described with reference to FIGS. 9 through 11. The second embodiment illustrated in FIGS. 9 through 11 is the same as the first embodiment illustrated in FIGS. 1 through 8 except for the configuration of the bellows portions 12.

Figure 9:
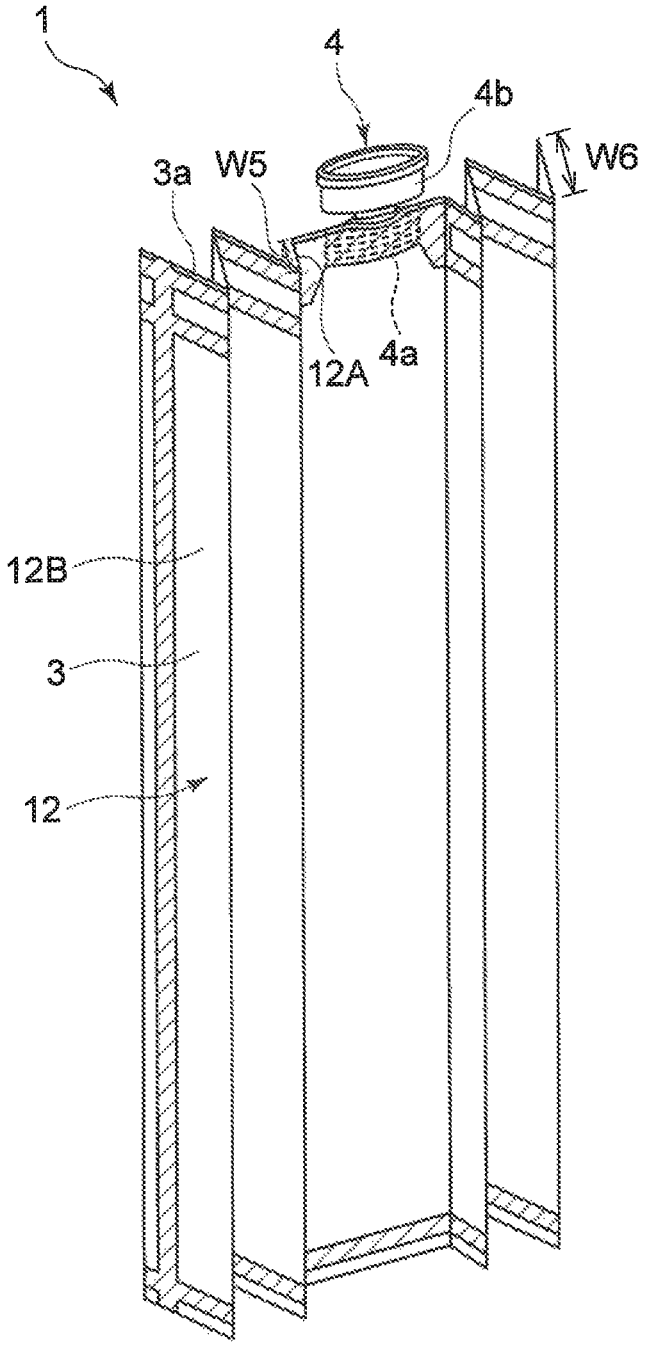
FIG. 9 is a perspective view of a liquid storage container according to the present invention.
Figure 10:
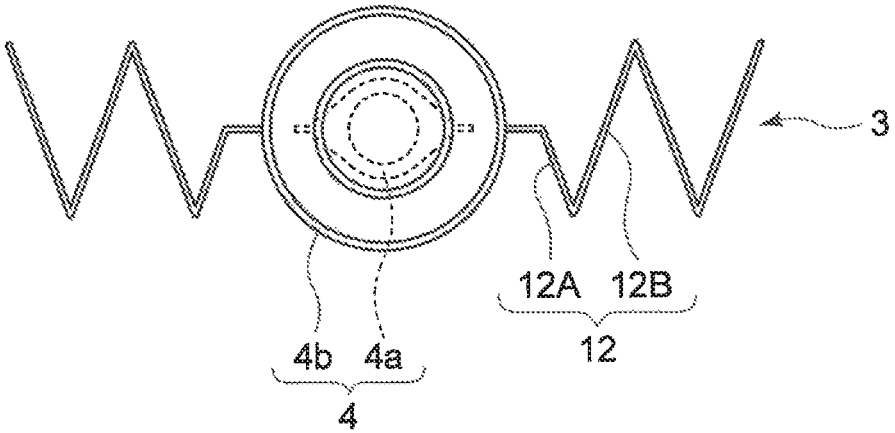
FIG. 10 is a plan view of the liquid storage container according to the present invention.
Figure 11:
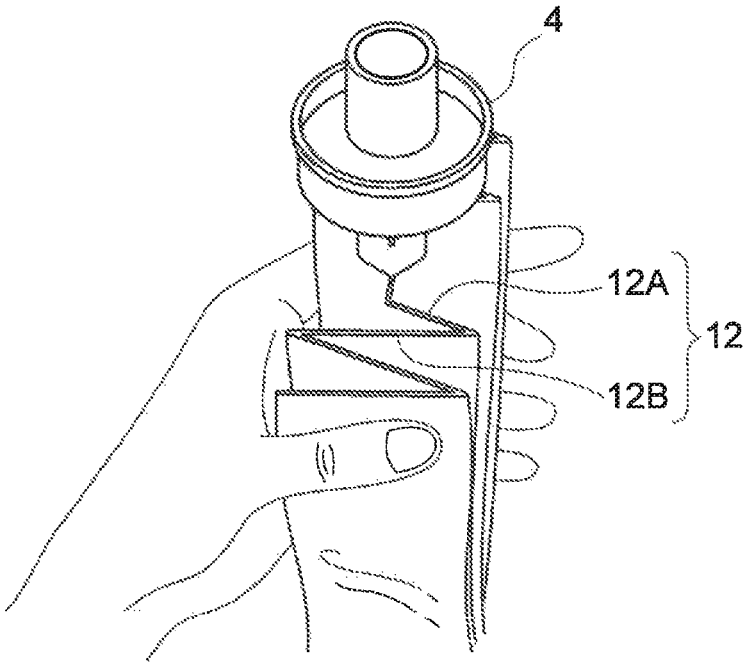
FIG. 11 is a diagram illustrating a folded state of the bag body of the liquid storage container according to the present invention.

For the second embodiment shown in FIGS. 9 through 11, the same reference numerals as used for the first embodiment shown in FIGS. 1 through 8 are used to refer to the same components, and a detailed description thereof is omitted.

As shown in FIGS. 9 through 11, a liquid storage container 1 includes a bag body 3 and an ejection outlet 4 fusion-bonded to the top periphery 3*a* of the bag body 3.

The ejection outlet 4 consists of an ejection outlet mount portion 4*a* having an elliptic cylindrical shape, and an ejection outlet engagement portion 4*b* connecting with the ejection outlet mount portion 4*a* and, in the ejection outlet mount portion 4*a*, is fusion-bonded to the top periphery 3*a* of the bag body 3 as shown in FIG. 9.

The bag body 3 comprises bellows portions 12 formed by accordion-folding the bag body 3 along a plurality of, for example six, longitudinal crease lines 11.

As described above, the ejection outlet 4 includes the ejection outlet mount portion 4*a* of an elliptic cylindrical shape. At least the pair of bellows portions 12A, lying adjacent to and on both sides of the ejection outlet mount portion 4*a*, of the bellows portions 12 each have a width W5. A total of four outer bellows portions 12B are provided outside the pair of bellows portions 12A in the width direction. Each outer bellows portion 12B has a width W6.

The pair of bellows portions 12A and the four outer bellows portions 12B intersect, preferably at a right angle, with a line extending from the long axis Z of the ellipse of the ejection outlet mount portion 4*a*.

The width W5 of each bellows portion 12A and the width W6 of each outer bellows portion 12B satisfy the relation:

$$W6/2 \geq W5 > 0$$

The bellows portions 12A are folded in the same direction as viewed from the ejection outlet mount portion 4*a*. By the phrase "folded in the same direction" is herein meant that the bellows portions 12A, lying on both sides of the ejection outlet mount portion 4*a*, are both folded forward (e.g. downward in FIG. 10) or folded backward (e.g. upward in FIG. 10).

The folded liquid storage container 1 is inserted through an opening 5*a* into an external corner 5. The ejection outlet engagement portion 4*b* is engaged with the opening 5*a*, and an inflating jig (not shown) is inserted into the though-hole 4*c* of the ejection outlet 4. Thereafter, an inflating cap (not shown) is mounted such that it covers the ejection outlet 4 and the opening 5*a*, whereby the ejection outlet 4 is secured to the opening 5*a*.

If bellows portions 12 are folded parallel to the long axis Z of the ellipse of the ejection outlet mount portion 4*a*, it is possible that when inflating the liquid storage container 1 within the external corner 5, the bellows portions 12 may not expand into a planar configuration and the bag body 3 may expand in a somewhat twisted state. In such a case, the bag body 3, in a portion just under the ejection outlet mount portion 4*a*, can remain in a twisted state after completion of the operation for inflating the liquid storage container 1.

When supplying a liquid to the liquid storage container 1, the inflating cap and the inflating jig are detached from the external container 5 and the ejection outlet 4, and a liquid supply nozzle (not shown) is mounted to the ejection outlet 4 through the though-hole 4*c*. During the supply of the liquid from the liquid supply nozzle into the liquid storage container 1, the twist of the bag body 3, remaining in the portion just under the ejection outlet mount portion 4*a*, can splash the liquid back toward the liquid supply nozzle and contaminate the external surface of the liquid supply nozzle.

According to this embodiment, on the other hand, the pair of bellows portions 12A and the four outer bellows portions 12B are folded in the same direction as viewed from the ejection outlet mount portion 4*a* and intersect at a right angle with a line extending from the long axis Z of the ellipse of the ejection outlet mount portion 4*a*. Therefore, the pair of bellows portions 12A and the four outer bellows portions 12B do not expand in a twisted state, but expand smoothly outward from the ejection outlet 4. The liquid storage container 1 of this embodiment therefore will not contaminate the external surface of the liquid supply nozzle (see FIG. 11).

The following examples further illustrate the present invention.

Example 3

Example 3 according to the second embodiment will now be described.

(1) Object of the Experiment

The formation of a wall due to twisting of a bag body was checked after folding the bellows portions of the bag body by different methods and inflating the bag body. If a wall is formed due to twisting of the bag body, the wall can splash a liquid, which has been supplied from a chemical supply nozzle, back toward the chemical supply nozzle and contaminate the nozzle.

(2) Size of the Bag Body H=660 mm, W=500 mm (3) Experimental Method

In Example 3-1, a liquid storage container was prepared which, as shown in FIGS. 9 through 11, has the pair of inner bellows portions and the outer bellows portions which are folded such that they intersect at a right angle with a line extending from the long axis of the ellipse of the ejection outlet mount portion.

Similarly, in Example 3-2, a liquid storage container, whose bellows portions are folded parallel to a line extending from the long axis of the ellipse of the ejection outlet mount portion, was prepared. In the liquid storage container, each triangular folded portion was formed by folding a plurality of side periphery-side bellows portions.

Similarly, in Example 3-3, a liquid storage container, whose bellows portions are folded parallel to a line extending from the long axis of the ellipse of the ejection outlet mount portion, was prepared. In the liquid storage container, each triangular folded portion was formed by folding a single side periphery-side bellows portion.

The liquid storage containers of Examples 3-1 to 3-3 were each put into an external container, and a gas was supplied into the liquid storage container to inflate it within the external container.

Thereafter, a CCD camera (1F11C5-20, Olympus) was inserted through the ejection outlet into the bag body to check if a wall was formed in the vicinity of the ejection outlet due to twisting of the bag body.

(4) Experimental Results

The results of the experiment are shown in Table 3 below.

TABLE 3

| Formation of a wall in the bag body | | | | | | | | | | | | |
|---|---|---|---|---|---|---|---|---|---|---|---|---|
| Level | 1 | 2 | 3 | 4 | 5 | 6 | 7 | 8 | 9 | 10 | Total | Wall formation probability |
| Example 3-1 | ○ | ○ | ○ | ○ | ○ | ○ | ○ | ○ | ○ | ○ | 0 | 0% |
| Example 3-2 | ○ | ○ | Δ | ○ | ○ | ○ | ○ | Δ | ○ | Δ | 3 | 30% |
| Example 3-3 | Δ | ○ | ○ | Δ | ○ | Δ | Δ | ○ | Δ | ○ | 5 | 50% |

Δ: A wall formed near the ejection outlet
○: No wall formed near the ejection outlet

Third Embodiment

A third embodiment of the present invention will now be described with reference to the drawings.

Figure 12:
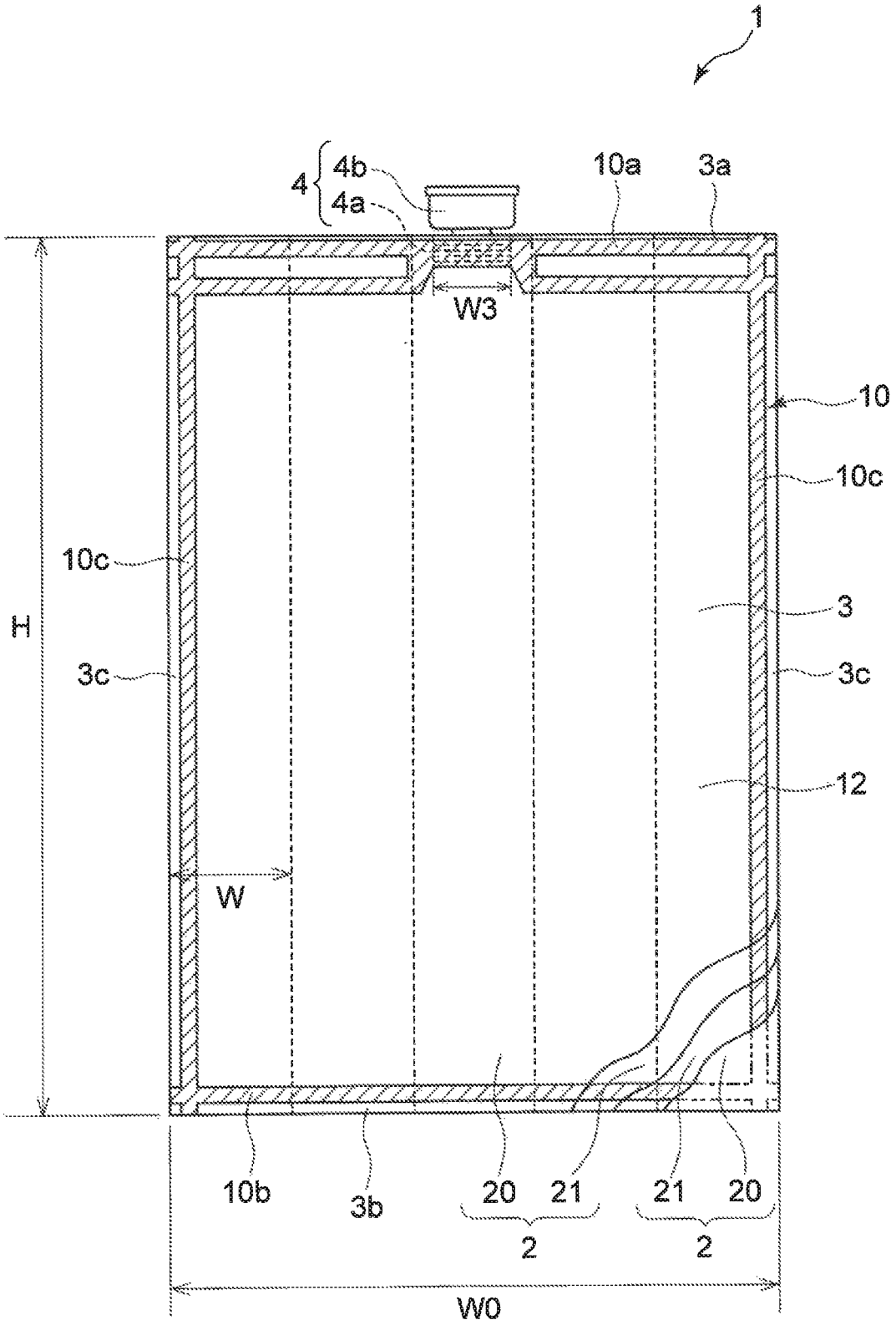
FIG. 12 is a plan view of a liquid storage container according to the present invention.
Figure 13A:
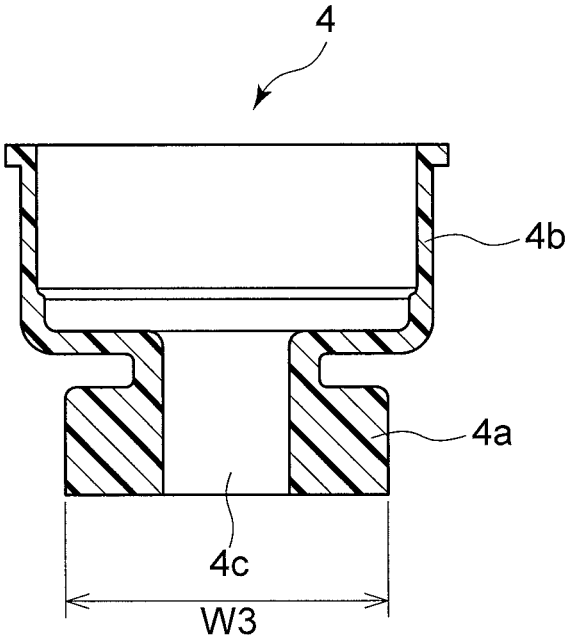
FIG. 13A is a cross-sectional view of the ejection outlet of the liquid storage container.
Figure 13B:
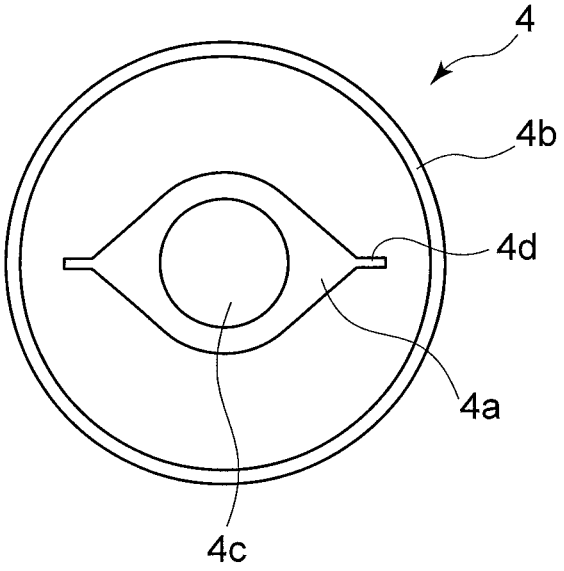
FIG. 13B is a bottom view of the ejection outlet.
Figure 14:
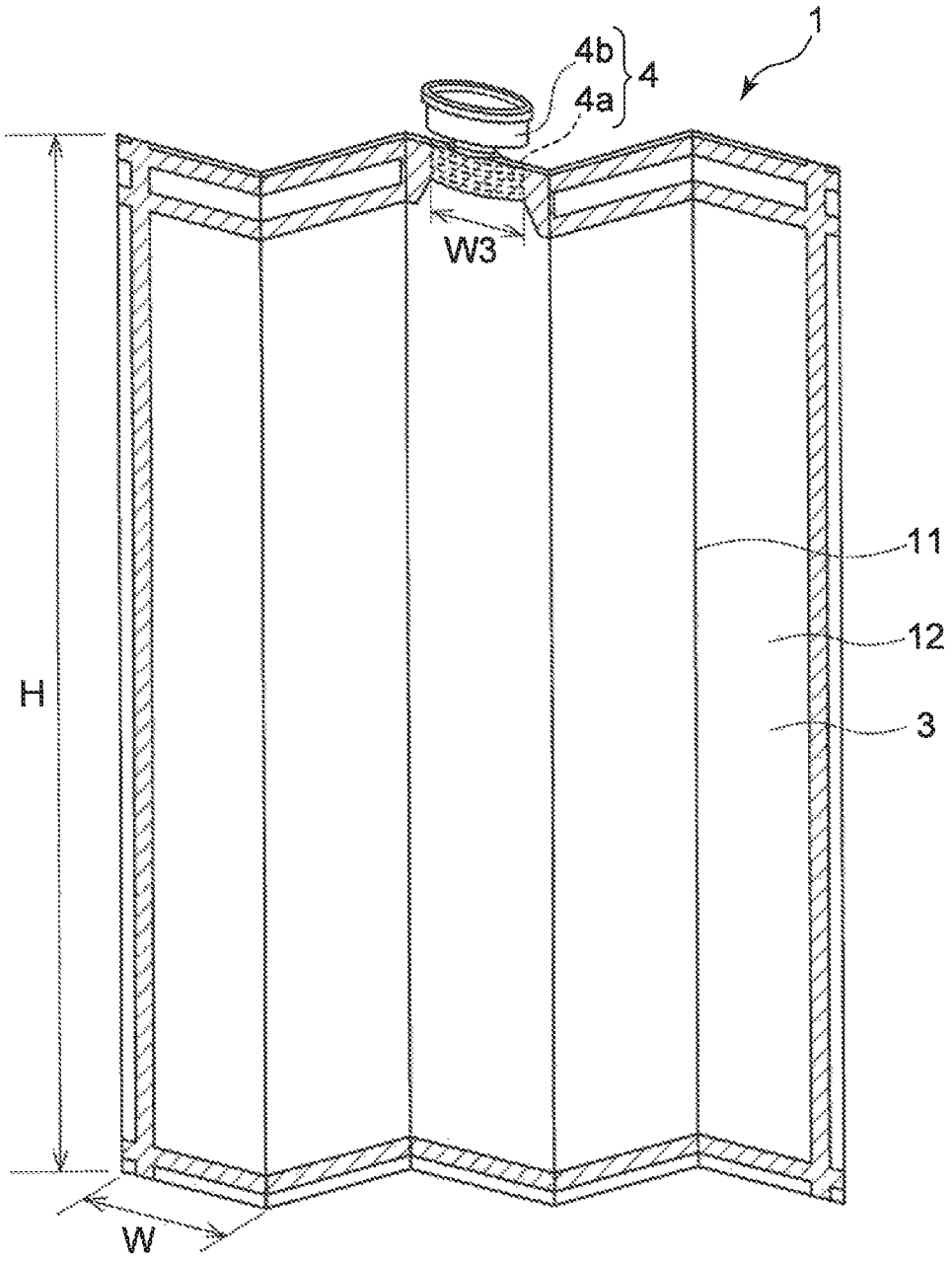
FIG. 14 is a diagram showing longitudinal crease lines of the bag body of the liquid storage container.

FIG. 12 is a plan view of a liquid storage container according to the third embodiment; FIG. 13A is a vertical cross-sectional view of an ejection outlet, and FIG. 13B is a bottom view of the ejection outlet as viewed from the side of an ejection outlet mount portion.

The liquid storage container 1 of this embodiment includes a bag body 3, produced by superimposing two multi-layer films 2, each comprising a laminate of an outer bag 20 and an inner bag 21, on each other such that the inner bags 21 of the films 2 face each other, and heat-sealing the four sides of the superimposed films to form a heat-sealed portion 10, and an ejection outlet 4 disposed on the top periphery 3*a* of the bag body 3 and fusion-bonded to the inner bags 21.

Though in this embodiment the bag body 3 is obtained by superimposing the multi-layer films 2 on each other such that the inner bags 21 of the films 2 face each other, and heat-sealing the four sides of the superimposed films to form the heat-sealed portion 10, the present invention is not limited to this method. For example, it is possible to fold three peripheral sides of the multi-layer films 2 such that the inner bags 21 of the film 2 face each other, and heat-seal the overlapping three sides. The heat-sealed portion 10 may have arc-shaped corners so that fluid contents are less likely to remain in the corners. The bag body 3 needs not necessarily be composed of a multi-layer film; the film construction of the bag body 3 can be arbitrarily determined depending on the contents and their amount.

As described above, the bag body 3 is obtained by superimposing the two multi-layer films 2 on each other, and heat-sealing the periphery of the superimposed films to form the heat-sealed portion 10. The bag body 3 has a rectangular shape having a top periphery 3*a*, a bottom periphery 3*b* and two side peripheries 3*c*, 3*c*. The top periphery 3*a* includes two top periphery heat-sealed portions 10*a*, the bottom periphery 3*b* includes a single bottom periphery heat-sealed portion 10*b*, and each side periphery 3*c*, 3*c* includes a single side periphery heat-sealed portion 10*c*. The top periphery heat-sealed portions 10*a*, the bottom periphery heat-sealed portion 10*b* and the side periphery heat-sealed portions 10*c* constitute the heat-sealed portion 10.

As described above, the top periphery 3*a* of the bag body 3 includes the two top periphery heat-sealed portions 10*a*. Compared to the case of forming a single heat-sealed portion, having a width equal to the sum of the widths of the two top periphery heat-sealed portions 10*a*, in the top periphery 3*a*, the provision of the two top periphery heat-sealed portions 10*a* according to this embodiment can make the top periphery 3*a* relatively flexible.

The ejection outlet 4 consists of an ejection outlet mount portion 4*a* and an ejection outlet engagement portion 4*b* connecting with the ejection outlet mount portion 4*a* and, in the ejection outlet mount portion 4*a*, is fusion-bonded to the inner bags 21 of the multi-layer films 2 as shown in FIG. 12.

As shown in FIGS. 13A and 13B, the ejection outlet mount portion 4*a* of the ejection outlet 4 has a flattened shape and has a central through-hole 4*c*. In general, when fusion-bonding the ejection outlet mount portion 4*a* of the ejection outlet 4 to the inner bags 21 of the multi-layer films 2, spaces are likely to be formed in two regions surrounded by the inner bags 21 and the side ends of the ejection outlet mount portion 4*a*, resulting in poor sealing of the ejection outlet mount portion 4*a*. In view of this, a pair of plate-like ribs 4*d* is provided at the side ends of the ejection outlet mount portion 4*a*. Upon fusion-bonding of the ejection outlet mount portion 4*a*, the plate-like ribs 4*d* are allowed to melt, which can prevent the formation of spaces around the side ends of the ejection outlet mount portion 4*a*. The ejection outlet mount portion 4*a* may have an elliptic cylindrical shape.

The ejection outlet 4 is preferably produced by injection molding. There is no particular limitation on a resin to be used as long as it is injection moldable. However, since the ejection outlet 4 is to be fusion-bonded to the interior surfaces of the inner bags 21 of the multi-layer films 2, the resin for the ejection outlet 4 needs to be appropriately selected depending on the type of the resin of the interior surfaces of the inner bags 21. A high-density polyethylene resin, which remains rigid at high temperatures and hardly becomes brittle at low temperatures, may be preferably used.

The multi-layer film 2, constituting the bag body 3, will now be described. In this embodiment the multi-layer film 2 is composed of a film constituting the outer bag 20 and a film constituting the inner bag 21.

As shown in FIG. 3, a laminate of unstretched nylon (thickness 20 μm) 20*a*/linear low-density polyethylene (thickness 40 μm) 20*b* can be used as the outer bag 20 of the bag body 3, while a linear low-density polyethylene (thickness 70 μm) can be used as the inner bag 21.

The inclusion of the unstretched nylon 20*a* in the outer bag 20 can increase the elongation of the outer bag 20. For example, the outer bag 20 has an elongation of 300% to 500%. The high elongation of the outer bag 20 can make the bag body 3 flexible as a whole. Therefore, when inserting the bag body 3 into an external container 5, and inflating the bag body 3 within the external container 5 by supplying nitrogen gas into the bag body 3 as described below, the bag body 3 can be inflated smoothly.

The material and the layer construction of the bag body 3 are not limited to those described above.

Examples of materials usable for the inner bag 21 include low-density polyethylene, a mixture of low-density polyethylene and linear low-density polyethylene, polypropylene, and a fluorine-containing resin.

Examples of materials usable for the outer bag 20 include nylon, polyethylene terephthalate, polybutylene terephthalate, a fluorine-containing resin, and a material having an elongation of 300% to 500%, such as a mixture of low-density polyethylene and linear low-density polyethylene.

The shape of the bag body 3 will now be described further. As shown e.g. in FIG. 12, the bag body 3 comprises a plurality of, for example five, bellows portions 12 formed by accordion-folding the bag body 3 along a plurality of, for example four, longitudinal crease lines 11.

The bellows portions 12 of the bag body 3 have approximately the same width W. The ejection outlet 4 mounted to the bag body 3 is disposed on the middle one of the five bellows portions 12.

The bag body 3 is folded along an upper lateral crease line 15*a* and a lower lateral crease line 15*b* to form a laterally-extending double-folded portion 16 as described below (see FIGS. 16 and 17).

Figure 16:
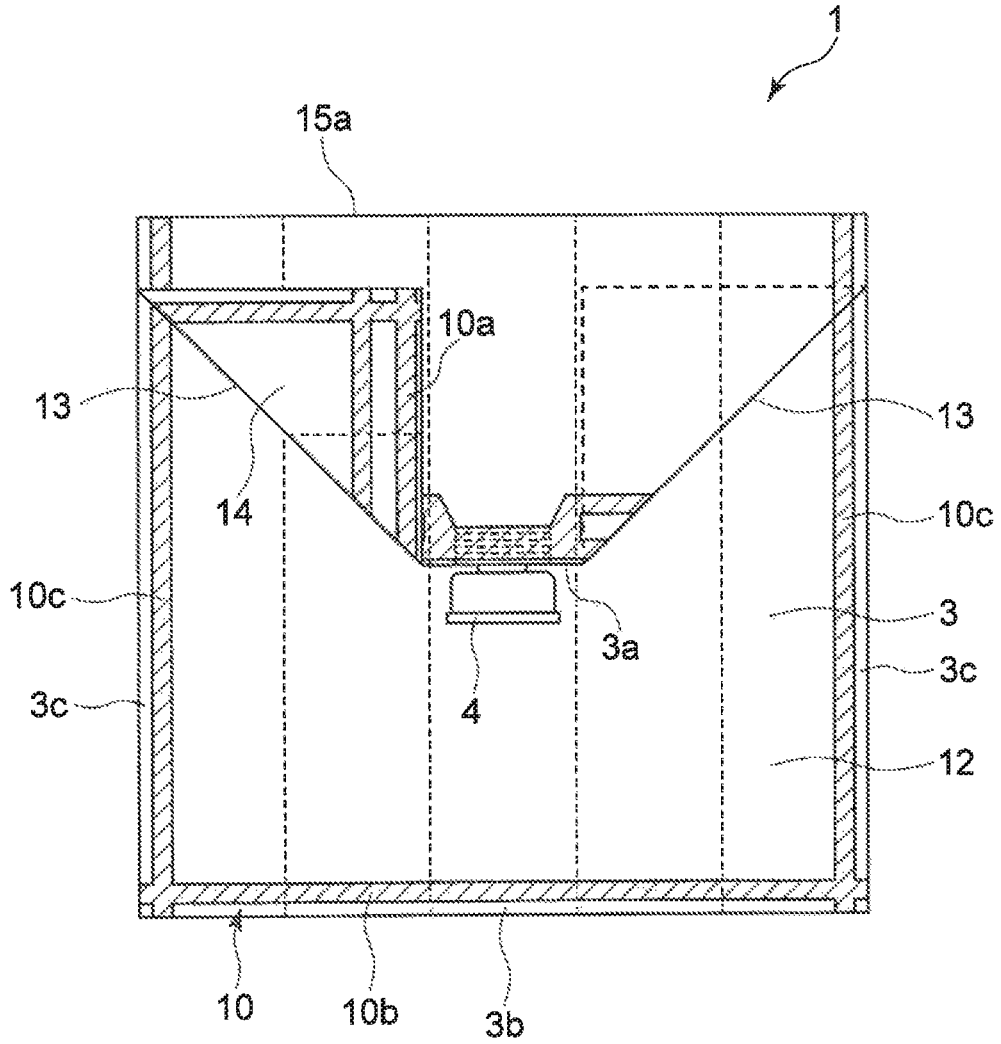
FIG. 16 is a diagram illustrating the method for folding the liquid storage container.
Figure 17:
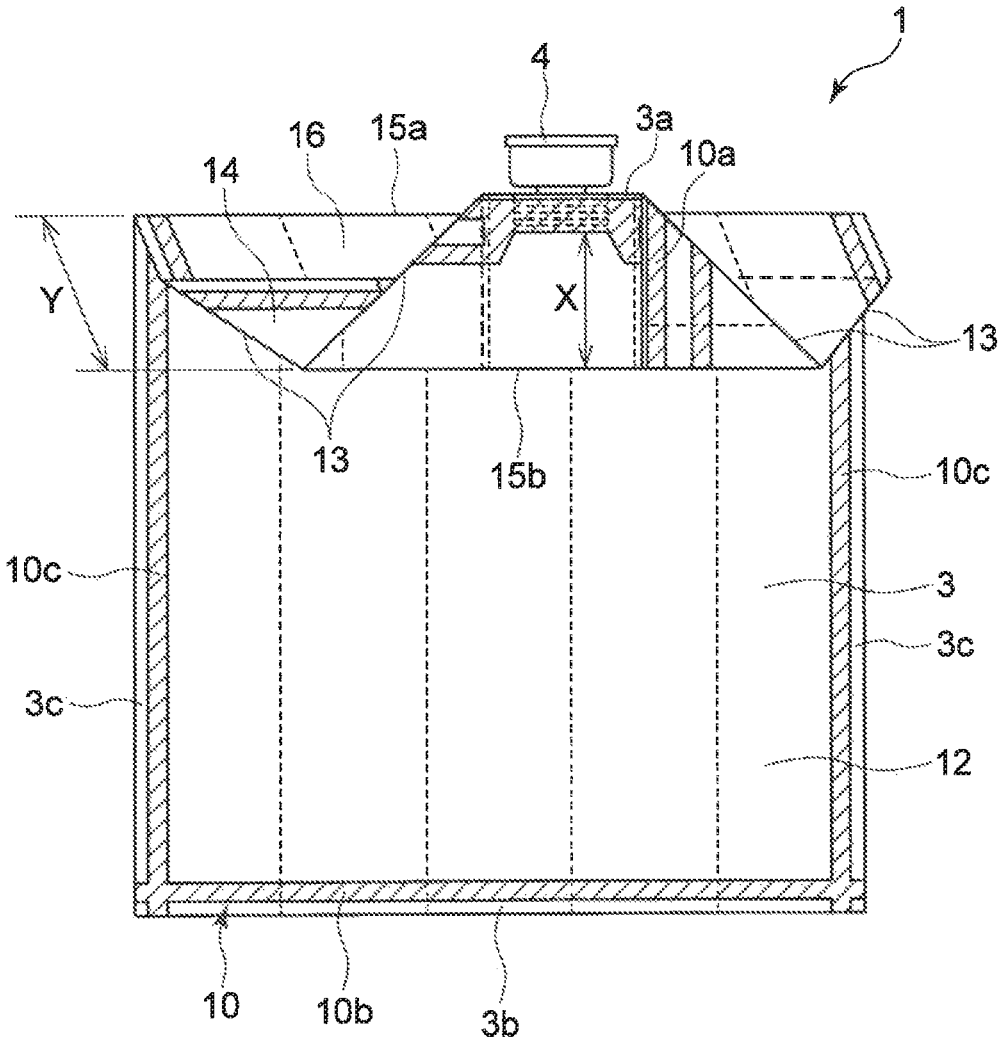
FIG. 17 is a diagram illustrating the method for folding the liquid storage container.

Referring to FIGS. 16 and 17, it is preferred that the following relations be satisfied:

$$10\% < X/H < 50\%, 3\% < Y/H < 25\%$$

where H is the length of the bag body 3 before folding, X is the distance between the top periphery 3*a* of the bag body 3 and the lower lateral crease line 15*b*, and Y is the distance between the upper lateral crease line 15*a* and the lower lateral crease line 15*b* (the height of the double-folded portion 16).

By making the ratio X/H lower than 50%, the double-folded portion 16 can be formed in an upper portion of the bag body 3. This can increase the weight of the portion of the bag body 3 which lies under the double-folded portion 16. After inserting the liquid storage container 1 into an external container 5, the portion of the bag body 3, lying under the double-folded portion 16, is allowed to securely fall by its own weight. Therefore, the liquid storage container 1 can be securely inflated within the external container 5.

By making the ratio X/H higher than 10%, the double-folded portion 16 having a sufficient length Y can be securely formed.

By making the ratio Y/H higher than 3%, the double-folded portion 16 having a sufficient length Y can be formed. When the relation X≥Y is satisfied, the ejection outlet engagement portion 4*b* can be positioned above the upper lateral crease line 15*a* without overlapping the double-folded portion 16. By making the ratio Y/H lower than 25%, a sufficient portion of the bag body 3 which lies under the double-folded portion 16 can be ensured; the portion of the bag body 3, lying under the double-folded portion 16, is allowed to securely fall by its own weight.

The bag body 3 has crease lines 13 extending between the top periphery 3*a* and the side peripheries 3*c*, 3*c*. A pair of triangular folded portions 14, 14 is formed by folding the corner portions between the top periphery 3*a* and the side peripheries 3*c*, 3*c* along the crease lines 13 (see FIG. 15).

While the pair of triangular folded portions 14, 14 is formed in the case where the upper corners of the bag body 3 are right-angled corners, a pair of arc-shaped folded portions is to be formed in the case where the upper corners of the bag body 3 are arc-shaped corners. The triangular folded portions 14, 14 and such arc-shaped folded portions may collectively be referred to herein as folded portions. While the triangular folded portions 14, 14 are illustrated in this embodiment, the present invention is not limited to triangular folded portions; arc-shaped folded portions or other shapes of folded portions may also be used.

When inserting the liquid storage container 1 through an opening 5*a* into an external container 5 and inflating the bag body 3 by supplying nitrogen gas into the liquid storage container 1, the triangular folded portions 14, 14 can prevent the corner portions between the top periphery 3*a* and the side peripheries 3*c*, 3*c* from sticking in the opening 5*a* of the external container 5, thereby preventing damage to the bag body 3, or preventing the bag body 3 from being insufficiently inflated and failing to obtain a sufficient interior volume.

Figure 15:
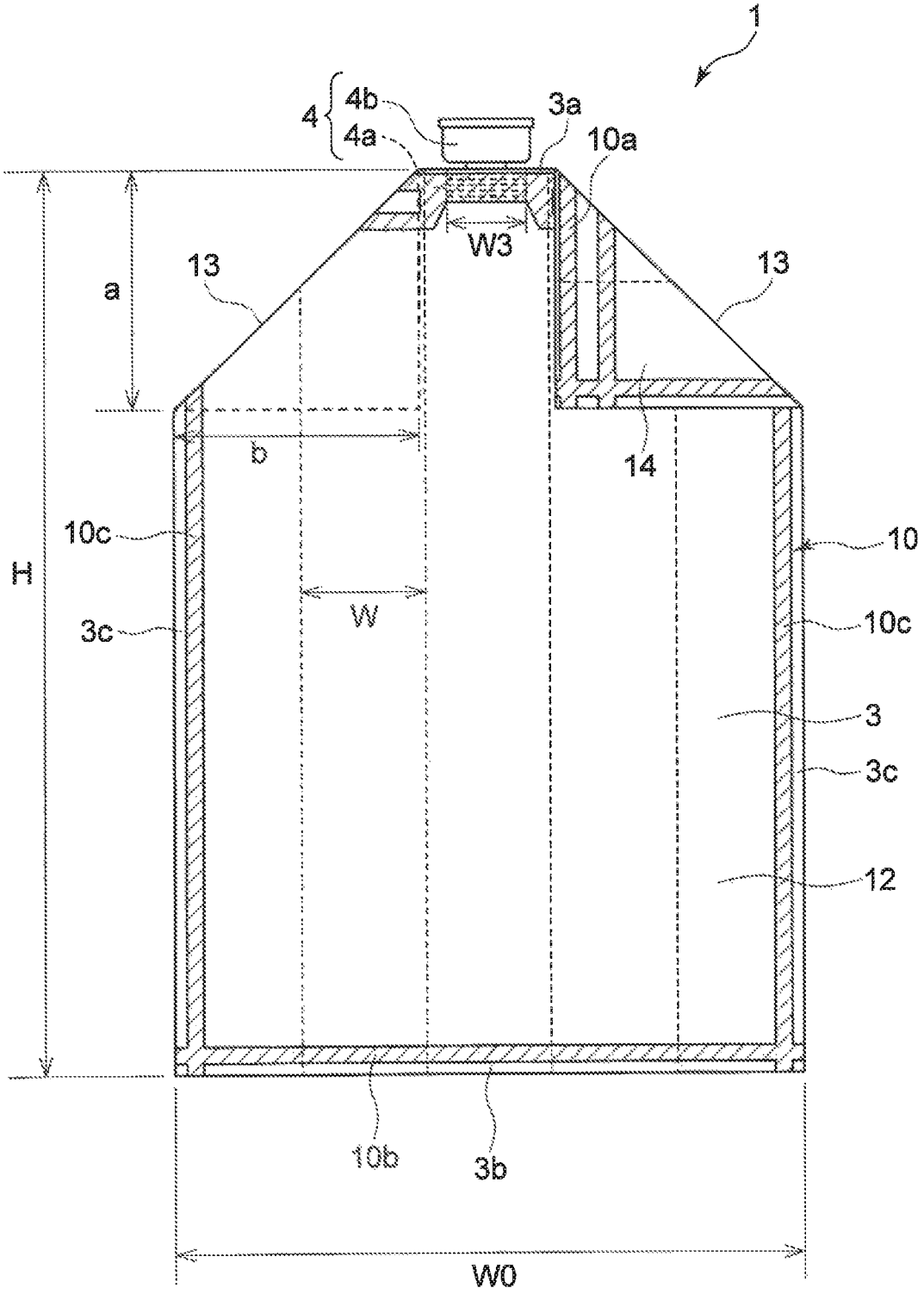
FIG. 15 is a diagram illustrating a method for folding the liquid storage container.

Referring to FIG. 15, the following relations are satisfied:

$$W<b\leq(W0-W3)/2, a=b$$

where a and b are the length and the width, respectively, of each triangular folded portion 14 of the bag body 3, W0 is the width of the bag body 3, W is the width of each bellows portion 12, and W3 is the width of the ejection outlet mount portion 4*a* of the ejection outlet 4.

However, a needs not necessarily be equal to b, i.e., a may be different from b. The length a of each triangular folded portion 14 refers to the distance from the point of intersection between a line extending from the top periphery 3*a* of the bag body 3 and a line extending from the side periphery 3*c* of the bag body 3 to the folding start position on the side periphery 3*c* of the triangular folded portion 14. The width b of each triangular folded portion 14 refers to the distance from the point of intersection between a line extending from the top periphery 3*a* of the bag body 3 and a line extending from the side periphery 3*c* of the bag body 3 to the folding start position on the top periphery 3*a* of the triangular folded portion 14.

As shown in FIG. 15, the right triangular folded portion 14 of the pair of triangular folded portions 14, 14 is folded forward, while the left triangular folded portion 14 is folded backward. The length a and the width b of the triangular folded portions 14, 14 are large as described above, and thus the triangular folded portions 14, 14 have a large shape.

When the bag body 3 is inserted into the external container 5, the triangular folded portions 14, 14, because of their large shape, are separated from the other portion of the bag body 3 due to the impact caused by the insertion of the bag body 3 into the external container 5, and never remain in contact with the other portion of the bag body 3. Therefore, when inflating the bag body 3 by supplying nitrogen gas to the liquid storage container 1, the triangular folded portions 14, 14 can be securely expanded.

If the width b of the triangular folded portions 14, 14 is smaller than the width W of the bellows portion 12, it is possible that when the bag body 3 is inserted into the external container 5, the triangular folded portions 14, 14 may not separate from the other portion of the bag body 3.

The maximum width b for forming the triangular folded portions 14, 14 with high accuracy is "(W0−W3)/2"; it is difficult to form with high accuracy the triangular folded portions 14, 14 having a width b of more than "(W0−W3)/2".

As described above, the right triangular folded portion 14 of the pair of triangular folded portions 14, 14 is folded forward, while the left triangular folded portion 14 is folded backward. Therefore, when inflating the bag body 3 by supplying nitrogen gas to the liquid storage container 1, the nitrogen gas is allowed to flow into the upper portions of the bag body 3 in a balanced manner, making it possible to securely inflate the upper portions. It is conceivable in this regard that if the triangular folded portions 14, 14 are folded in the same direction, the nitrogen gas supplied may not fully reach the side of the bag body 3 on which the triangular folded portions 14, 14 are folded. In contrast, by folding the triangular folded portions 14, 14 in opposite directions, the nitrogen gas supplied is allowed to flow into the upper portions of the bag body 3 in a balanced manner. This can prevent the bag body 3 from blocking the ejection outlet 4 due to unbalanced flow of nitrogen gas.

The bellows portions 12 need not necessarily have the same width W, i.e. the bellows portions 12 may have different widths W. In that case, the following relation is satisfied: $W_R<b_R\leq(W0-W3)/2$, where $b_R$ is the width of the right triangular folded portion 14 of the pair of triangular folded portions 14, 14 of the bag body 3, and $W_R$ is the width of the rightmost bellows portion 12, including the right side periphery heat-sealed portion 10*c*, of the bellows portions 12 of the bag body 3. Further, the following relation is satisfied: $W_L<b_L\leq(W0-W3)/2$, where $b_L$ is the width of the left triangular folded portion 14 of the pair of triangular folded portions 14, 14 of the bag body 3, and $W_L$ is the width of the leftmost bellows portion 12, including the left side periphery heat-sealed portion 10*c*, of the bellows portions 12 of the bag body 3.

The operation of the thus-constructed liquid storage container 1 according to this embodiment will now be described.

At the outset, a method for folding the liquid storage container 1 and putting it into an external container 5 will be described with reference to FIGS. 15 through 19.

First, as shown in FIG. 15, the bag body 3 of the liquid storage container 1 is folded, in the corner portions between the top periphery 3*a* and the side peripheries 3*c*, 3*c*, along the crease lines 13 extending between the top periphery 3*a* and the side peripheries 3*c*, 3*c*, thereby forming the pair of triangular folded portions 14, 14 in the bag body 3. The right triangular folded portion 14 is folded forward, while the left triangular folded portion 14 is folded backward.

Next, as shown in FIG. 16, an upper portion of the bag body 3 of the liquid storage container 1 is folded forward along the upper lateral crease line 15*a*.

Next, as shown in FIG. 17, an upper portion of the forward-folded portion of the bag body 3 is folded backward along the lower lateral crease line 15*b*, thereby forming the double-folded portion 16 between the upper lateral crease line 15*a* and the lower lateral crease line 15*b*.

Figure 18:
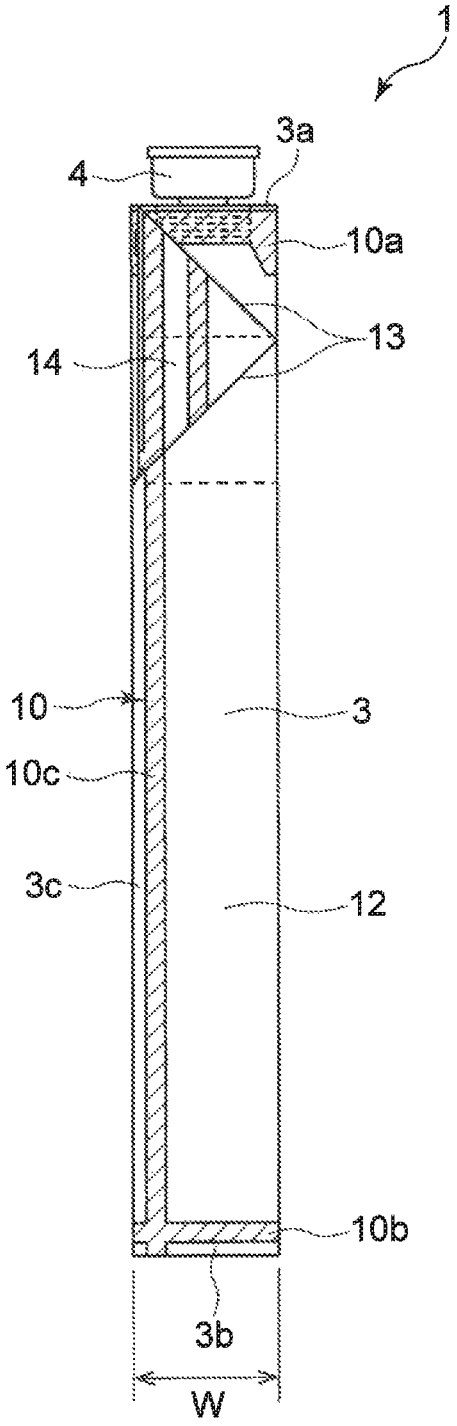
FIG. 18 is a diagram illustrating the method for folding the liquid storage container.

Thereafter, as shown in FIG. 18, the bag body 3 is folded longitudinally along the longitudinal crease lines 11 to form the bellows portions 12. Next, a lower portion of the bag body 3 is folded horizontally to form the bottom folded portion 17 (see FIG. 19).

Figure 19:
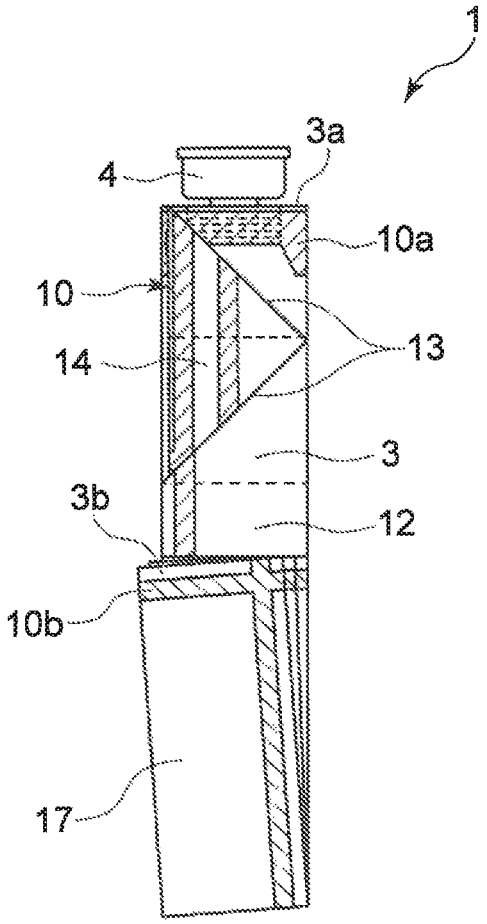
FIG. 19 is a diagram illustrating the method for folding the liquid storage container.

The liquid storage container 1, having the bellows portions 12, the double-folded portion 16, the pair of triangular folded portions 14, 14, and the bottom folded portion 17, is thus prepared as shown in FIG. 19.

Figure 20A:
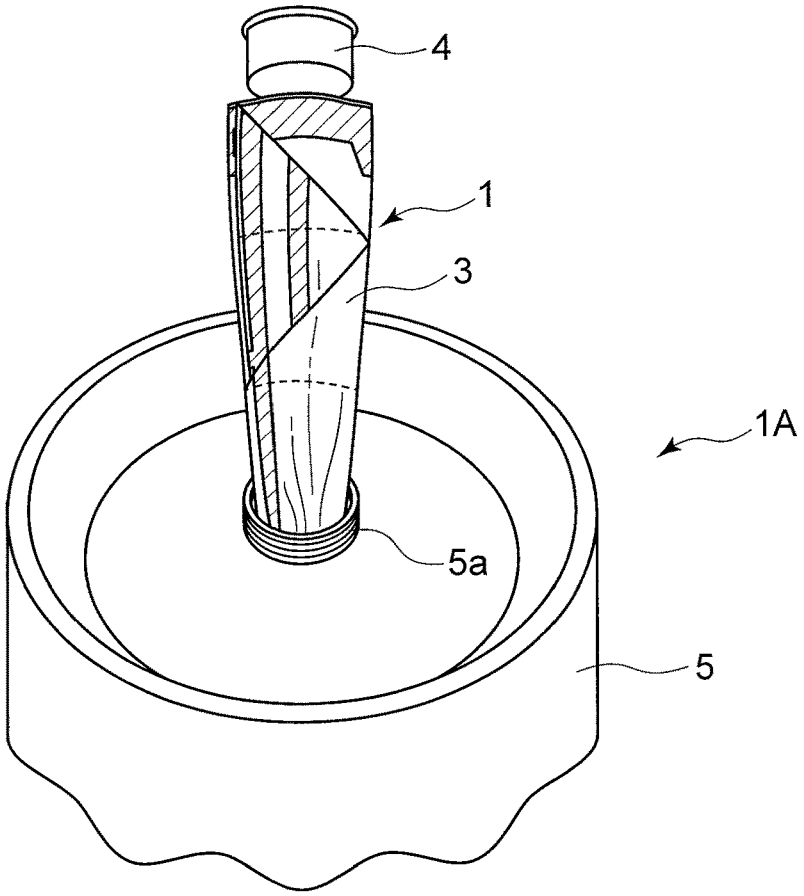
FIGS. 20A and 20B are diagrams illustrating insertion of the liquid storage container into an external container.
Figure 20B:
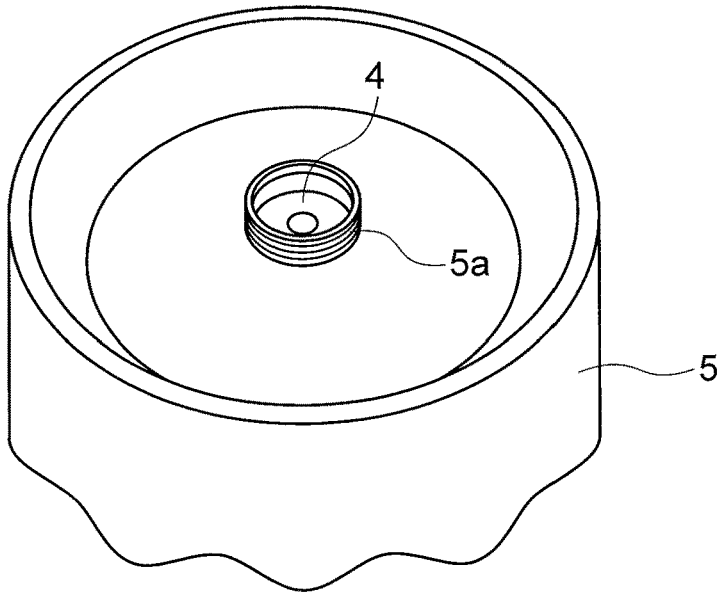

Next, as shown in FIG. 20A, the liquid storage container 1 is further folded longitudinally into a longitudinally elongated shape, and is inserted through the opening 5*a* into the external container 5.

Next, the ejection outlet 4 of the liquid storage container 1 is mounted in the opening 5*a* of the external container 5 by engagement of the ejection outlet engagement portion 4*b* with the opening 5*a* of the external container 5. The liquid storage container 1 is thus put into the external container 5, constructing an assembly 1A of the external container and the liquid storage container.

A method for filling a liquid will now be described.

First, nitrogen gas is supplied through the ejection outlet 4 into the liquid storage container 1 of the assembly 1A, thereby inflating the bag body 3 of the liquid storage container 1 within the external container 5.

After thus inflating the bag body 3 with nitrogen gas, a not-shown liquid tube is inserted through the ejection outlet 4 into the liquid storage container 1, and liquid contents (liquid) are filled through the liquid tube into the liquid storage container 1. The liquid contents in the liquid storage container 1 are later ejected from the ejection outlet 4 through the liquid tube. In particular, a suction pump is mounted to the opposite end of the liquid tube from the end which is inserted into the ejection outlet 4, so that the liquid contents can be ejected from the liquid storage container 1 through suction by the suction pump. Alternatively, it is possible to supply a compressed gas, such as compressed air, through the ejection outlet 4 into the space between the external container 5 and the liquid storage container 1. The compressed gas supplied presses on the liquid storage container 1 from the outside and causes the liquid contents to be ejected through the liquid tube.

The liquid filling method will be further described below.

When the liquid storage container 1 is inserted into the external container 5, the bellows portions 12 of the bag body 3 of the liquid storage container 1 first expand laterally due to the impact caused by the insertion of the liquid storage container 1 into the external container 5. Subsequently, the pair of triangular folded portions 14, 14 of the bag body 3 is separated from the other portion of the bag body 3, and thus never remains in contact with the other portion of the bag body 3. Thereafter, the portion of the bag body 3, lying under the double-folded portion 16, falls by its own weight, whereby the bag body 3 further expands within the external container 5.

Next, the bag body 3 is inflated by supplying nitrogen gas into the liquid storage container 1. With the supply of the gas, the bag body 3, which has been accordion-folded along the longitudinal crease lines 11, expands into a planar configuration.

The pair of triangular folded portions 14, 14, formed by folding the bag body 3 along the crease lines 13, is provided in the upper portions of the bag body 3. The nitrogen gas, which has been supplied into the bag body 3, flows into the pair of triangular folded portions 14, 14 and gradually expands the triangular folded portions 14, 14. Therefore, when the bag body 3 expands, the corner portions of the top periphery 3*a* of the bag body 3 do not stick in the opening 5*a* of the external container 5. This prevents damage to the bag body 3. Further, since the triangular folded portions 14, 14 are folded in opposite directions, forward and backward, the nitrogen gas which has been supplied into the bag body 3 is allowed to flow into the upper portions of the bag body 3 in a balanced manner. This can securely expand the pair of triangular folded portions 14, 14. In addition, this can prevent the bag body 3 from blocking the ejection outlet 4 due to unbalanced flow of nitrogen gas.

Further, since the top periphery 3*a* of the bag body 3 includes the two top periphery heat-sealed portions 10*a*, the top periphery 3*a* can be made relatively flexible as compared to the case of providing a single wide heat-sealed portion. The bag body 3 can therefore be inflated more smoothly within the external container 5. Furthermore, when the outer bag 20 has an elongation of 300% to 500%, the bag body 3 can have increased flexibility. This facilitates the operation of expanding the bag body 3.

Example 4

Example 4 according to the third embodiment will now be described.

(1) Object of the Experiment

An experiment was conducted to determine the influence of a method for folding the bag body of a liquid storage container on the frequency of blocking of the ejection outlet of the container with the bag body.

(2) Size of the Bag Body H=660 mm, W0=500 mm (3) Experimental Method

In Example 4, a liquid storage container was prepared which includes a bag body having the pair of triangular folded portions, the double-folded portion and the bellows portions shown in Table 5 below.

Similarly, in Comp. Example 4, a liquid storage container was prepared which includes a bag body having the double-folded portion and the bellows portions shown in Table 5 below (but having no triangular folded portion).

The liquid storage containers of Example 4 and Comp. Example 4 were each put into an external container having a net interior volume of 20.4 L, which was used as a container that ensures a volume of 19 L, and a gas was supplied into the liquid storage container to inflate it within the external container.

The liquid storage container was then checked for the frequency of blocking of the ejection outlet with the bag body. The check of blocking was performed by visual observation of the though-hole of the ejection outlet of the inflated container from above the ejection outlet. The blocking was estimated to be poor (X) when the through-hole was completely blocked by the bag body film, and good (O) when the through-hole was not blocked at all or only partly blocked.

(4) Experimental Results

In Example 4, the ejection outlet was completely blocked with a probability of about 20%.

In Comp. Example 4, the ejection outlet was completely blocked with a probability of about 60%.

The results of the experiment are shown in Table 4 below.

TABLE 4

| Folding method and blocking frequency | | | | | | | | | | | |
|---|---|---|---|---|---|---|---|---|---|---|---|
| Level | 1 | 2 | 3 | 4 | 5 | 6 | 7 | 8 | 9 | X total | Blocking probability |
| Example 4 | X | ○ | ○ | ○ | X | ○ | ○ | ○ | ○ | 2 | 22% |
| Comp. Example 4 | X | X | X | X | ○ | ○ | ○ | X | ○ | 6 | 56% |

X: Completely blocked
○: Not blocked or partly blocked

The configurations of the bag bodies of Example 4 and Comp. Example 4 are shown in Table 5 below.

TABLE 5

| Level | Folded state | W [mm] | a [mm] | b [mm] | X [mm] | Y [mm] |
|---|---|---|---|---|---|---|
| Example 4 | With triangular folded portion | 100 | 200 | 180 | 150 | 100 |
| Comp. Example 4 | Without triangular folded portion | 100 | — | — | 150 | 100 |

Example 5

Example 5 according to the third embodiment will now be described.

(1) Object of the Experiment

An experiment was conducted to estimate the degree of inflation of the bag body of a liquid storage container in relation to the bag body folding method used.

(2) Size of the Bag Body H=660 mm, W0=500 mm (3) Experimental Method

In Examples 5-1 to 5-3, liquid storage containers were prepared which each include a bag body having the pair of triangular folded portions, the double-folded portion and the bellows portions shown in Table 6 below.

The liquid storage containers of Examples 5-1 to 5-3 were each put into an external container having a net interior volume of 20.4 L, which was used as a container that ensures a volume of 19 L, and a gas was supplied into the liquid storage container to inflate it within the external container. Next, water was filled into the inflated bag body, and the amount (volume) of water that fills the bag body was measured. The degree of inflation of the bag body was estimated by the measured amount of water.

(4) Experimental Results

Example 5-1

The pair of triangular folded portions was folded in the same direction in the upper corner portions of the bag body, and then the bellows portions were formed. The amount of filling water was 19.4 L.

Example 5-2

The pair of triangular folded portions was folded in opposite directions in the upper corner portions of the bag body: one of the pair of triangular folded portions was folded forward, and the other was folded backward. Subsequently, the bellows portions were formed. The amount of filling water was 19.6 L.

The comparative data demonstrates that the liquid storage container of Example 5-2, in which the pair of triangular folded portions was folded in opposite directions, has a somewhat higher degree of inflation of the bag body than the liquid storage container of Example 5-1 in which the pair of triangular folded portions was folded in the same direction.

Example 5-3

The pair of triangular folded portions was folded in opposite directions in the upper corner portions of the bag body. Subsequently, the double-folded portion was formed, and then the bellows portions were formed. The amount of filling water was 19.9 L.

Because of the formation of the double-folded portion, the liquid storage container of Example 5-3 has a higher degree of inflation.

In particular, in the liquid storage container of Example 5-3 having the double-folded portion, the bag body begins to inflate in the upper portion, which increases the degree of inflation of the upper corner portions.

Further, the formation of the double-folded portion can prevent an extra lower portion of the bag body from being bent or folded and thereby decreasing the degree of inflation of the bag body.

The amounts of filling water in Examples 5-1 to 5-3 are shown in Table 6 below (n=3).

No blocking of the ejection outlet with the bag body occurred in any of the liquid storage containers of Examples 5-1 to 5-3.

Table 6 shows the folding methods and the amounts of filling water in Examples 5-1 to 5-3.

In table 6, the values of the "amount of filling water" are each the average value in three tests.

TABLE 6

Relationship between folding method and the amount of filling water

| Level | Folded state | W [mm] | a [mm] | b [mm] | X [mm] | Y [mm] | Amount of filling water [L] |
|---|---|---|---|---|---|---|---|
| Example 5-1 | Triangular folded portions(*1), bellows portions | 100 | 200 | 180 | — | — | 19.4 |
| Example 5-2 | Triangular folded portions(*2), bellows portions | 100 | 200 | 180 | — | — | 19.6 |
| Example 5-3 | Triangular folded portions(*3), Bellows portions, double-folded portion | 100 | 200 | 180 | 150 | 100 | 19.9 |

(*1)Folded in the same direction
(*2)Folded in opposite directions
(*3)Folded in opposite directions Example 6

Example 6 according to the third embodiment will now be described.

(1) Object of the Experiment

An experiment was conducted to determine the influence of the position of the double-folded portion in the bag body of a liquid storage container on the degree of inflation of the bag body.

(2) Size of the Bag Body H=660 mm, W0=500 mm, W=100 mm, a=200 mm, b=180 mm (3) Experimental Method In Examples 6-1 and 6-2 and Comp. Examples 6-1 to 6-4, liquid storage containers were prepared which each include a bag body having the pair of triangular folded portions, the double-folded portion and the bellows portions, shown above and in Table 7 below. As in Examples 5-1 to 5-3, the liquid storage containers of Examples 6-1 and 6-2 and Comp. Examples 6-1 to 6-4 were each put into an external container having a net interior volume of 20.4 L, which was used as a container that ensures a volume of 19 L, and a gas was supplied into the liquid storage container to inflate it within the external container. Next, water was filled into the inflated bag body, and the amount (volume) of water that fills the bag body was measured. The degree of inflation of the bag body was estimated by the measured amount of water.

(4) Experimental Results

Examples 6-1 and 6-2

The liquid storage container of Example 6-1 was found to have a sufficient volume of 19.9 L. However, handling of the liquid storage container upon its insertion into the external container was somewhat difficult because of the large fold provided near the ejection outlet on the upper side of the bag body. If the ratio X/H and the ratio Y/H are decreased from the test values, insertion of the liquid storage container into the external container will be difficult.

The liquid storage container of Example 6-2 was found to have a volume of 19.5 L, which is smaller by 4.4% than the interior volume (20.4 L) of the external container. If the ratio X/H and the ratio Y/H are increased from the test values, the portion of the bag body, lying under the double-folded portion, will not securely fall by its own weight, and therefore the degree of inflation of the bag body may decrease and it will be difficult to ensure a sufficient volume of the liquid storage container.

Comp. Examples 6-1 to 6-4

The liquid storage container of Comp. Example 6-1 was found to have a volume of 19.0 L, which is smaller by about 6.9% than the interior volume (20.4 L) of the external container. Further, there was a case in which the liquid storage container was found to have a volume of less than 19.0 L. Thus, a sufficient volume cannot be ensured for the comparative liquid storage container.

The liquid storage containers of Comp. Examples 6-2 and 6-3 were found to have a volume of 17.9 L and 18.9 L, respectively, which are smaller by 12.3% and 7.4% than the interior volume (20.4 L) of the external container. It is clear from the data that a sufficient volume cannot be ensured for the comparative liquid storage containers.

The liquid storage container of Comp. Example 6-4 was found to have a volume of 19.1 L, which is smaller by 6.4% than the interior volume (20.4 L) of the external container. Further, there was a case in which the liquid storage container was found to have a volume of less than 19.0 L. Thus, a sufficient volume cannot be stably ensured for the comparative liquid storage container.

The experimental data thus demonstrates that the comparative liquid storage containers, which are folded in such a manner as not to satisfy the relations 10%<X/H<50%, 3%<Y/H<25%, are poor in the degree of inflation, and none of the comparative containers can securely achieve an amount of filling water at the satisfactory level of 19 L.

A comparative liquid storage container having a too small X value cannot ensure sufficient X and Y values because of the small double-folded portion. Such a container has handling problems such as its non-compact folded configuration, the inability to maintain the folded state, etc.

A comparative liquid storage container having a too small Y value likewise has handling problems such as its non-compact folded configuration, the inability to maintain the folded state, etc.

The experimental results for Examples 6-1 and 6-2 and Comp. Examples 6-1 to 6-4 are shown in Table 7 below.

In table 7, the values of the "average amount of filling water" are each the average value in three tests.

TABLE 7

| Level | X [mm] | Y [mm] | X/H [%] | Y/H [%] | Average amount of filling water [L] |
|---|---|---|---|---|---|
| Example 6-1 | 72.6 | 26.4 | 11 | 4 | 19.9 |
| Example 6-2 | 323.4 | 158.4 | 49 | 24 | 19.4 |
| Comp. Example 6-1 | 396 | 100 | 60 | 15 | 19.0 |
| Comp. Example 6-2 | 231 | 231 | 35 | 35 | 17.9 |
| Comp. Example 6-3 | 231 | 198 | 35 | 30 | 18.9 |
| Comp. Example 6-4 | 363 | 198 | 55 | 30 | 19.1 |

DESCRIPTION OF THE REFERENCE NUMERALS

1 liquid storage container
1A assembly of external container and liquid storage container
2 multi-layer film
3 bag body
3*a* top periphery
3*b* bottom periphery
3*c* side periphery
4 ejection outlet
4*a* ejection outlet mount portion
4*b* ejection outlet engagement portion
4*c* ejection outlet through-hole
4*d* plate-like rib
5 external container
5*a* opening of external container
10 heat-sealed portion
10*a* top periphery heat-sealed portions
10*b* bottom periphery heat-sealed portion
10*c* side periphery heat-sealed portion
11 longitudinal crease line
12 bellows portion
12A pair of bellows portions
12A outer bellows portions
13 crease line
14 triangular folded portion
15*a* upper lateral crease line
15*b* lower lateral crease line
16 double-folded portion
17 bottom folded portion
20 outer bag
21 inner bag
H height of bag body
X distance between top periphery and lower lateral crease line
Y distance between upper lateral crease line and lower lateral crease line
a height of triangular folded portion b width of triangular folded portion W width of bellows portion

The invention claimed is:

1. A liquid storage container comprising:

a bag body defining a first interior surface and an opposing second interior surface and a first exterior surface on a first side and a second exterior surface on a second side, and a top edge and a bottom edge; and an ejection outlet for filling liquid contents, the ejection outlet being attached to the bag body at a first portion, wherein:

the bag body comprises a plurality of bellows portions that include accordion-folds that extend in a lengthwise direction of the bag body along lengthwise crease lines, the plurality of bellows portions being sectioned by a first lateral crease line and a second lateral crease line, such that, in a state where one side of the bag body, which includes the first interior surface, is folded along the first lateral crease line and the second lateral crease line, the first interior surface of the bag body contacts the opposing second interior surface of the bag body at the first lateral crease line and the second lateral crease line;

when the bag body is viewed in cross-section from the top edge, the bag body is divided by at least four consecutive creases, the ejection outlet being oriented between a second consecutive crease and a third consecutive crease, and a first bellows portion defined between a first consecutive crease and the second consecutive crease, and a second bellows portion defined between the third consecutive crease and a fourth consecutive crease, the first bellows portion and the second bellows portions are folded such that a first exterior surface of the first bellows portion and a first exterior surface of the second bellows portion face each other, wherein the first exterior surface of the first bellows portion and the first exterior surface of the second bellows portion are on the first side.

2. The liquid storage container according to claim 1, wherein the bag body has two lateral crease lines.

3. The liquid storage container according to claim 2, wherein the bag body is folded into a Z-shape along the two lateral crease lines.

4. The liquid storage container according to claim 3, wherein the two lateral crease lines comprise an upper lateral crease line and a lower lateral crease line, wherein the following relationships are satisfied:

$3\% < Y/H < 25\%$ such that H is the length of the bag body, and Y is the distance between the upper lateral crease line and the lower lateral crease line.

5. The liquid storage container according to claim 3, wherein the two lateral crease lines comprise an upper lateral crease line and a lower lateral crease line, wherein the following relationships are satisfied:

$3\% < Y/H < 10\%$ such that H is the length of the bag body, and Y is the distance between the upper lateral crease line and the lower lateral crease line.

6. The liquid storage container of claim 1, wherein the first bellows portion and the second bellows portion are folded such that the first exterior surface of the first bellows portion and the first exterior surface of the second bellows portion are folded toward the ejection outlet.

7. The liquid storage container of claim 1, wherein the first bellows portion and the second bellows portion are folded such that the first exterior surface of the first bellows portion and the first exterior surface of the second bellows portion are folded toward a first exterior surface of the ejection outlet, which is defined between the second consecutive crease and the third consecutive crease, wherein the first exterior surface of the ejection outlet is on the first side.

8. A liquid storage container comprising:

a bag body that comprises:

a first side including a first interior surface and a first exterior surface on a first side, a first lateral crease line and a second lateral crease line;

a second side with an opposing second interior surface and a second exterior surface on a second side;

a top edge and a bottom edge;

an ejection outlet for filling liquid contents, the ejection outlet being attached to the bag body at a first portion; and a plurality of bellows portions including:

accordion-folds that extend in a lengthwise direction of the bag body along lengthwise crease lines such that, in a state where the first side of the bag body is folded along the first lateral crease line and the second lateral crease line, the first interior surface contacts the opposing second interior surface at the first lateral crease line and at the second lateral crease line, and wherein when the bag body is viewed in cross-section from the top edge, the bag body is divided by at least four consecutive creases, the ejection outlet being oriented between a second consecutive crease and a third consecutive crease, and a first bellows portion defined between a first consecutive crease and the second consecutive crease, and a second bellows portion defined between the third consecutive crease and a fourth consecutive crease, the first bellows portion and the second bellows portions are folded such that a first exterior surface of the first bellows portion and a first exterior surface of the second bellows portion face each other, wherein the first exterior surface of the first bellows portion and the first exterior surface of the second bellows portion are on the first side.

9. The liquid storage container of claim 8, wherein the first bellows portion and the second bellows portion are folded such that the first exterior surface of the first bellows portion and the first exterior surface of the second bellows portion are folded toward the ejection outlet.

10. The liquid storage container of claim 8, wherein the first bellows portion and the second bellows portion are folded such that the first exterior surface of the first bellows portion and the first exterior surface of the second bellows portion are folded toward a first exterior surface of the ejection outlet, which is defined between the second consecutive crease and the third consecutive crease, wherein the first exterior surface of the ejection outlet is on the first side.

* * * * *